US006388645B2

(12) United States Patent
Kasahara et al.

(10) Patent No.: US 6,388,645 B2
(45) Date of Patent: May 14, 2002

(54) DISPLAY APPARATUS CAPABLE OF ADJUSTING SUBFIELD NUMBER ACCORDING TO BRIGHTNESS

(75) Inventors: Mitsuhiro Kasahara, Hirakata; Yuichi Ishikawa, Ibaraki; Tomoko Morita, Hirakata, all of (JP)

(73) Assignee: Matsushita Electric Industrial Co. Ltd., Osaka (JP)

( * ) Notice: Subject to any disclaimer, the term of this patent is extended or adjusted under 35 U.S.C. 154(b) by 0 days.

(21) Appl. No.: 09/788,511

(22) Filed: Feb. 21, 2001

Related U.S. Application Data

(62) Division of application No. 09/355,341, filed as application No. PCT/JP98/05510 on Dec. 7, 1998, now Pat. No. 6,331,843.

(30) Foreign Application Priority Data

Dec. 10, 1997 (JP) ..... 9-340418
Sep. 25, 1998 (JP) ..... 10-271030

(51) Int. Cl.[7] ..... G09G 3/28
(52) U.S. Cl. ..... 345/63; 345/60
(58) Field of Search ..... 345/60, 63, 89, 345/77, 101, 690–693; 382/237, 274; 358/455, 456, 458; 348/797

(56) References Cited

U.S. PATENT DOCUMENTS

| | | | | |
|---|---|---|---|---|
| 4,864,392 A | * | 9/1989 | Sato | 358/523 |
| 5,008,698 A | * | 4/1991 | Muramatsu et al. | 396/234 |
| 5,162,785 A | * | 11/1992 | Fagard | 345/87 |
| 5,757,343 A | | 5/1998 | Nagakubo | 345/63 |
| 6,034,656 A | | 3/2000 | Yamamoto et al. | 345/60 |

FOREIGN PATENT DOCUMENTS

| | | |
|---|---|---|
| EP | 0653740 | 5/1995 |
| EP | 0831643 | 3/1998 |
| JP | 6259034 | 9/1994 |
| JP | 7-44127 | 2/1995 |
| JP | 7-72825 | 3/1995 |
| JP | 7140928 | 6/1995 |
| JP | 8286636 | 11/1996 |
| JP | 8511635 | 12/1996 |
| JP | 9-68945 | 3/1997 |
| JP | 9127911 | 5/1997 |
| JP | 9-185343 | 7/1997 |
| JP | 10-91121 | 4/1998 |
| JP | 10105116 | 4/1998 |
| JP | 10282929 | 10/1998 |
| JP | 11-65521 | 3/1999 |
| JP | 11119730 | 4/1999 |
| KR | 97-17861 | 4/1997 |
| WO | 95/27970 | 10/1995 |

OTHER PUBLICATIONS

An English Language abstract of JP 6–259034.
An English Language abstract of JP 11–119730.
An English Language abstract of JP 8–286636.
An English Language abstract of JP 9–127911.
An English Language abstract of JP 10–91121.
An English Language abstract of JP 10–105116.
An English Language abstract of JP 8–511635.
"New Category Contour Noise Observed in Pulse–Width–Modulated Moving Images", T. Masuda et al., ITEJ Tech. Report, vol. 19, No. 2, IDY95–21, published on Jan. 19, 1995, with a partial English translation.
English Language Abstract of JP 7–44127.
English Language Abstract of JP 9–68945.
English Language Abstract of JP 9–185343.

* cited by examiner

*Primary Examiner*—Richard Hjerpe
*Assistant Examiner*—Alexander Eisen
(74) *Attorney, Agent, or Firm*—Greenblum & Bernstein, P.L.C.

(57) ABSTRACT

A display apparatus adjusts the brightness of a plasma display panel. The display apparatus comprises an adjusting device, which acquires image brightness data, and adjusts the number of subfields Z on the basis of brightness data.

9 Claims, 17 Drawing Sheets

Fig.1A

SF1

| | | | | | | | | | |
|---|---|---|---|---|---|---|---|---|---|
| 0 | 0 | 0 | 0 | 0 | 0 | 0 | 0 | 0 | 0 |
| 0 | 1 | 1 | 1 | 1 | 1 | 0 | 0 | 0 | 0 |
| 0 | 1 | 0 | 0 | 0 | 0 | 0 | 0 | 0 | 0 |
| 0 | 1 | 0 | 1 | 1 | 1 | 0 | 0 | 0 | 0 |

Fig.1B

SF2

| | | | | | | | | | |
|---|---|---|---|---|---|---|---|---|---|
| 0 | 0 | 0 | 0 | 0 | 0 | 0 | 0 | 0 | 0 |
| 0 | 1 | 1 | 1 | 1 | 1 | 0 | 0 | 0 | 0 |
| 0 | 1 | 1 | 1 | 1 | 1 | 0 | 0 | 0 | 0 |
| 0 | 1 | 1 | 0 | 0 | 0 | 0 | 0 | 0 | 0 |

Fig.1C

SF3

| | | | | | | | | | |
|---|---|---|---|---|---|---|---|---|---|
| 0 | 0 | 0 | 0 | 0 | 0 | 0 | 0 | 0 | 0 |
| 0 | 1 | 1 | 1 | 1 | 1 | 0 | 0 | 0 | 0 |
| 0 | 1 | 1 | 1 | 1 | 1 | 0 | 0 | 0 | 0 |
| 0 | 1 | 1 | 1 | 1 | 1 | 0 | 0 | 0 | 0 |

Fig.1D

SF4

| | | | | | | | | | |
|---|---|---|---|---|---|---|---|---|---|
| 0 | 0 | 0 | 0 | 0 | 0 | 0 | 0 | 0 | 0 |
| 0 | 1 | 1 | 1 | 1 | 1 | 0 | 0 | 0 | 0 |
| 0 | 1 | 1 | 1 | 1 | 1 | 0 | 0 | 0 | 0 |
| 0 | 1 | 1 | 1 | 1 | 1 | 0 | 0 | 0 | 0 |

Fig.1E

SF5

| | | | | | | | | | |
|---|---|---|---|---|---|---|---|---|---|
| 0 | 0 | 0 | 0 | 0 | 0 | 0 | 0 | 0 | 0 |
| 0 | 1 | 1 | 1 | 1 | 1 | 0 | 0 | 0 | 0 |
| 0 | 1 | 1 | 1 | 1 | 1 | 0 | 0 | 0 | 0 |
| 0 | 1 | 1 | 1 | 1 | 1 | 0 | 0 | 0 | 0 |

Fig.1F

SF6

| | | | | | | | | | |
|---|---|---|---|---|---|---|---|---|---|
| 0 | 0 | 0 | 0 | 0 | 0 | 0 | 0 | 0 | 0 |
| 0 | 1 | 1 | 1 | 1 | 1 | 0 | 0 | 0 | 0 |
| 0 | 1 | 1 | 1 | 1 | 1 | 0 | 0 | 0 | 0 |
| 0 | 1 | 1 | 1 | 1 | 1 | 0 | 0 | 0 | 0 |

Fig.1G

SF7

| | | | | | | | | | |
|---|---|---|---|---|---|---|---|---|---|
| 0 | 0 | 0 | 0 | 0 | 0 | 0 | 0 | 0 | 0 |
| 0 | 1 | 1 | 1 | 1 | 1 | 0 | 0 | 0 | 0 |
| 0 | 1 | 1 | 1 | 1 | 1 | 0 | 0 | 0 | 0 |
| 0 | 1 | 1 | 1 | 1 | 1 | 0 | 0 | 0 | 0 |

Fig.1H

SF8

| | | | | | | | | | |
|---|---|---|---|---|---|---|---|---|---|
| 1 | 1 | 1 | 1 | 1 | 1 | 0 | 0 | 0 | 0 |
| 1 | 0 | 0 | 0 | 0 | 0 | 0 | 0 | 0 | 0 |
| 1 | 0 | 0 | 0 | 0 | 0 | 0 | 0 | 0 | 0 |
| 1 | 0 | 0 | 0 | 0 | 0 | 0 | 0 | 0 | 0 |

1-TIMES MODE
8 SUBFIELDS
256 GRADATIONS

1-TIMES MODE
9 SUBFIELDS
256 GRADATIONS

DISPLAY APPARATUS CAPABLE OF ADJUSTING SUBFIELD NUMBER ACCORDING TO BRIGHTNESS

This is a divisional of U.S. application Ser. No. 09/355,341, filed Aug. 5, 1999 now U.S. Pat. No. 6,331,843 which was the National Stage of International Application No. PCT/JP98/05510, filed Dec. 7, 1998, the contents of which are expressly incorporated by reference herein in their entireties. The International Application was published in English.

DESCRIPTION

1. Technical Field

The present invention relates to a display apparatus of a plasma display panel (PDP) and digital micromirror device (DMD), and more specifically, to a display apparatus capable of adjusting a subfield number in accordance with brightness.

2. Background Art

A display apparatus of a PDP and a DMD makes use of a subfield method, which has binary memory, and which displays a dynamic image possessing half tones by temporally superimposing a plurality of binary images that have each been weighted. The following explanation deals with PDP, but applies equally to DMD as well.

A PDP subfield method is explained using FIGS. 1, 2, and 3.

Now, consider a PDP with pixels lined up 10 across and 4 vertically, as shown in FIG. 3. Let the respective R,G,B of each pixel be 8 bits, assume that the brightness thereof is rendered, and that a brightness rendering of 256 gradations (256 gray scales) is possible. The following explanation, unless otherwise stated, deals with a G signal, but the explanation applies equally to R, B as well.

The portion indicated by A in FIG. 3 has a signal level of brightness of 128. If this is displayed in binary, a (1000 0000) signal level is added to each pixel in the portion indicated by A. Similarly, the portion indicated by B has a brightness of 127, and a (0111 1111) signal level is added to each pixel. The portion indicated by C has a brightness of 126, and a (0111 1110) signal level is added to each pixel. The portion indicated by D has a brightness of 125, and a (0111 1101) signal level is added to each pixel. The portion indicated by E has a brightness of 0, and a (0000 0000) signal level is added to each pixel. Lining up an 8-bit signal for each pixel perpendicularly in the location of each pixel, and horizontally slicing it bit-by-bit produces a subfield. That is, in an image display method, which utilizes the so-called subfield method, by which 1 field is divided into a plurality of differently weighted binary images, and displayed by temporally superimposing these binary images, a subfield is 1 of the divided binary images.

Since each pixel is displayed using 8 bits, as shown in FIG. 2, 8 subfields can be achieved. Collect the least significant bit of the 8-bit signal of each pixel, line them up in a 10×4 matrix, and let that be subfield SF1 (FIG. 2). Collect the second bit from the least significant bit, line them up similarly into a matrix, and let this be subfield SF2. Doing this creates subfields SF1, SF2, SF3, SF4, SF5, SF6, SF7, SF8. Needless to say, subfield SF8 is formed by collecting and lining up the most significant bits.

FIG. 4 shows the standard form of a 1 field PDP driving signal. As shown in FIG. 4, there are 8 subfields SF1, SF2, SF3, SF4, SF5, SF6, SF7, SF8 in the standard form of a PDP driving signal, and subfields SF1 through SF8 are processed in order, and all processing is performed within 1 field time.

The processing of each subfield is explained using FIG. 4. The processing of each subfield constitutes setup period P1, write period P2 and sustain period P3. At setup period P1, a single pulse is applied to a sustaining electrode, and a single pulse is also applied to each scanning electrode (There are only up to 4 scanning electrodes indicated in FIG. 4 because there are only 4 scanning lines shown in the example in FIG. 3, but in reality, there are a plurality of scanning electrodes, 480, for example.). In accordance with this, preliminary discharge is performed.

At write period P2, a horizontal-direction scanning electrodes scans sequentially, and a predetermined write is performed only to a pixel that received a pulse from a data electrode. For example, when processing subfield SF1, a write is performed for a pixel represented by "1" in subfield SF1 depicted in FIG. 2, and a write is not performed for a pixel represented by "0."

At sustain period P3, a sustaining pulse (driving pulse) is outputted in accordance with the weighted value of each subfield. For a written pixel represented by "1," a plasma discharge is performed for each sustaining pulse, and the brightness of a predetermined pixel is achieved with one plasma discharge. In subfield SF1, since weighting is "1," a brightness level of "1" is achieved. In subfield SF2, since weighting is "2," a brightness level of "2" is achieved. That is, write period P2 is the time when a pixel which is to emit light is selected, and sustain period P3 is the time when light is emitted a number of times that accords with the weighting quantity.

As shown in FIG. 4, subfields SF1, SF2, SF3, SF4, SF5, SF6, SF7, SF8 are weighted at 1, 2, 4, 8, 16, 32, 64, 128, respectively. Therefore, the brightness level of each pixel can be adjusted using 256 gradations, from 0 to 255.

In the B region of FIG. 3, light is emitted in subfields SF1, SF2, SF3, SF4, SF5, SF6, SF7, but light is not emitted in subfield SF8. Therefore, a brightness level of "127" (=1+2+4+8+16+32+64) is achieved.

And in the A region of FIG. 3, light is not emitted in subfields SF1, SF2, SF3, SF4, SF5, SF6, SF7, but light is emitted in subfield SF8. Therefore, a brightness level of "128" is achieved.

With the PDP subfield method explained above, to provide an optimum screen display in bright places and dark places, it is necessary to make adjustment in accordance with the brightness of an image.

A PDP display apparatus capable of brightness control is disclosed in the specification of Kokai No. (1996)-286636 (corresponds to specification in U.S. Pat. No. 5,757,343), but here, only light emission frequency and gain control are performed in accordance with brightness, making adequate adjustment impossible.

An object of the present invention is to provide a display apparatus capable of adjusting a subfield number in accordance with brightness, designed to be able to adjust the number of subfields in accordance with the brightness of an image (comprising both a dynamic image and a static image). The average level of brightness, peak level, PDP power consumption, panel temperature, contrast and other factors are used as parameters that represent image brightness.

By increasing the subfield number, it is possible to eliminate pseudo-contour noise, which is explained below, and conversely, by decreasing the subfield number, although there is the likelihood that pseudo-contour noise will occur, it is possible to produce a clearer image.

Pseudo-contour noise is explained below.

Assume that regions A, B, C, D from the state shown in FIG. 3 have been moved 1 pixel width to the right as shown in FIG. 5. Thereupon, the viewpoint of the eye of a person looking at the screen also moves to the right so as to follow regions A, B, C, D. Thereupon, 3 vertical pixels in region B (the B1 portion of FIG. 3) will replace 3 vertical pixels in region A (A1 portion of FIG. 5) after 1 field. Then, at the point in time when the displayed image changes from FIG. 3 to FIG. 5, the eye of a human being is cognizant of region B1, which takes the form of a logical product (AND) of B1 region data (01111111) and A1 region data (10000000), that is (00000000). That is, the B1 region is not displayed at the original 127 level of brightness, but rather, is displayed at a brightness level of 0. Thereupon, an apparent dark borderline appears in region B1. If an apparent change from "1" to "0" is applied to an upper bit like this, an apparent dark borderline appears.

Conversely, when an image changes from FIG. 5 to FIG. 3, at the point in time when it changes to FIG. 3, a viewer is cognizant of region A1, which takes the form of a logical sum (OR) of A1 region data (10000000) and B1 region data (01111111), that is (11111111). That is, the most significant bit is forcibly changed from "0" to "1," and in accordance with this, the A1 region is not displayed at the original 128 level of brightness, but rather, is displayed at a roughly 2-fold brightness level of 255. Thereupon, an apparent bright borderline appears in region A1. If an apparent change from "0" to "1" is applied to an upper bit like this, an apparent bright borderline appears.

In the case of a dynamic image only, a borderline such as this that appears on a screen is called pseudo-contour noise ("pseudo-contour noise seen in a pulse width modulated motion picture display": Television Society Technical Report, Vol. 19, No. 2, IDY95-21 pp. 61–66), causing degradation of image quality.

DISCLOSURE OF INVENTION

According to the present invention, a display apparatus creates Z subfields from a first to a Zth. The display apparatus brightens or darkens the overall image by amplifying a picture signal using a multiplication factor A. The display apparatus performs weighting for each subfield, outputs a drive pulse of a number N-times this weighting, or outputs a drive pulse of a time length N-times this weighting, and adjusts brightness in accordance with the total drive pulse number in each pixel, or the total drive pulse time. In the picture signal, the brightness of each pixel is expressed by Z bits to indicate a particular gradation of the total gradations K. The first subfield is formed by collecting the 0 and 1 from the entire screen only a first bit of Z bits. The second subfield is formed by collecting the 0 and 1 from the entire screen only a second bit of Z bits. In this manner a first to a Zth subfields are formed. The display apparatus adjusts the subfield number in accordance with brightness. To this end, according to the present invention, the display apparatus comprises brightness detecting means, which acquire image brightness data; and adjusting means, which adjust the subfield number Z based on brightness data.

According to the present invention, a display apparatus creates, for each picture, Z subfields from a first to a Zth in accordance with Z bit representation of each pixel, weighting N to each subfield, a multiplication factor A for amplifying a picture signal, and a number of gradation display points K, said display apparatus comprises:

brightness detecting means, which acquire image brightness data; and adjusting means, which adjust the subfield number Z based on brightness data.

According to a preferred embodiment, said brightness detecting means comprises average level detecting means, which detects an average level (Lav) of image brightness.

According to a preferred embodiment, said brightness detecting means comprises peak level detecting means, which detects a peak level (Lpk) of image brightness.

According to a preferred embodiment, said brightness detecting means comprises power consumption detecting means, which detects the power consumption of a display panel on which an image is depicted.

According to a preferred embodiment, said brightness detecting means comprises panel temperature detecting means, which detects the temperature of a display panel on which an image is depicted.

According to a preferred embodiment, said brightness detecting means comprises contrast detecting means, which detects the contrast of a display panel on which an image is depicted.

According to a preferred embodiment, said brightness detecting means comprises ambient illumination detecting means, which detects the peripheral brightness of a display panel on which an image is depicted.

According to a preferred embodiment, the apparatus further comprises image characteristic determining means, which generates multiplication factor A based on brightness data, and multiplication means, which amplifies a picture signal A times based on multiplication factor A.

According to a preferred embodiment, the apparatus further comprises image characteristic determining means, which generates total number of gradations K based on brightness data, and display gradation adjusting means, which changes a picture signal to the nearest gradation level based on total number of gradations K.

According to a preferred embodiment, the apparatus further comprises image characteristic determining means, which generates the weighting N based on brightness data, and weight setting means, which multiplies N-times the weight of each subfield based on multiple N.

According to a preferred embodiment, said weight setting means is a pulse number setting means, which sets a drive pulse number.

According to a preferred embodiment, said weight setting means is a pulse width setting means, which sets a drive pulse width.

According to a preferred embodiment, the subfield number Z is reduced as the average level (Lav) of said brightness decreases.

According to a preferred embodiment, the apparatus further comprises image characteristic determining means, which generates the multiplication factor A based on brightness data, and multiplying means, which amplifies a picture signal A times based on multiplication factor A, and increases multiplication factor A as the average level (Lav) of said brightness decreases.

According to a preferred embodiment, the apparatus further comprises image characteristic determining means, which generates a weighting multiplier N based on brightness data, and increases a multiplication result of multiplication factor A and weighting multiplier N as the average level (Lav) of said brightness decreases.

According to a preferred embodiment, the apparatus further comprises image characteristic determining means, which generates a weighting multiplier N based on brightness data, and increases weighting multiplier N as the average level (Lav) of said brightness decreases.

According to a preferred embodiment, the subfield number Z is increased as said peak level (Lpk) decreases.

According to a preferred embodiment, the apparatus further comprising image characteristic determining means, which generates multiplication factor A based on brightness data, and multiplying means, which amplifies a picture signal A times based on multiplication factor A, and increases multiplication factor A as said peak level (Lpk) decreases.

According to a preferred embodiment, the apparatus further comprises image characteristic determining means, which generates a weighting multiplier N based on brightness data, and decrease weighting multiplier N as said peak level (Lpk) decreases.

BRIEF DESCRIPTION OF DRAWINGS

FIGS. 1A–1H illustrate a diagram of subfields SF1-SF8.

BEST MODE FOR CARRYING OUT THE INVENTION

Figure 2:
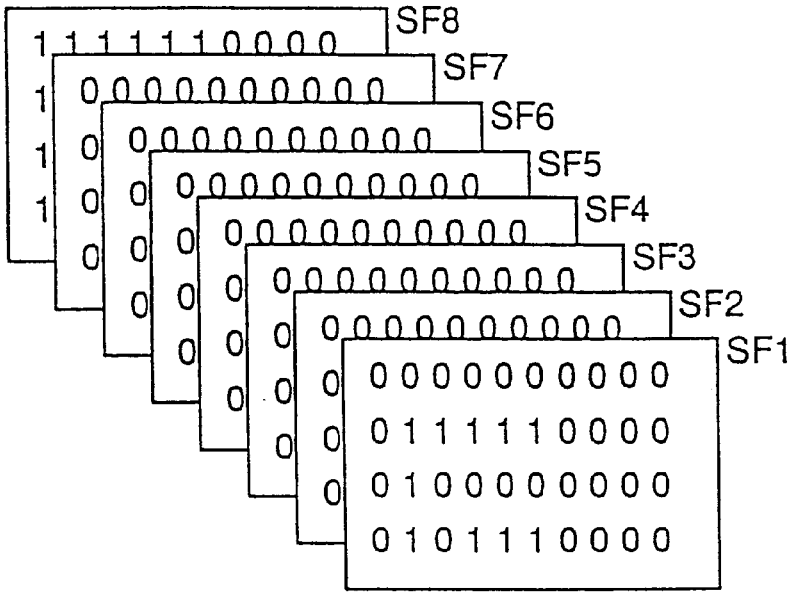
FIG. 2 illustrates a diagram in which subfields SF1-SF8 overlay one another.
Figure 3:
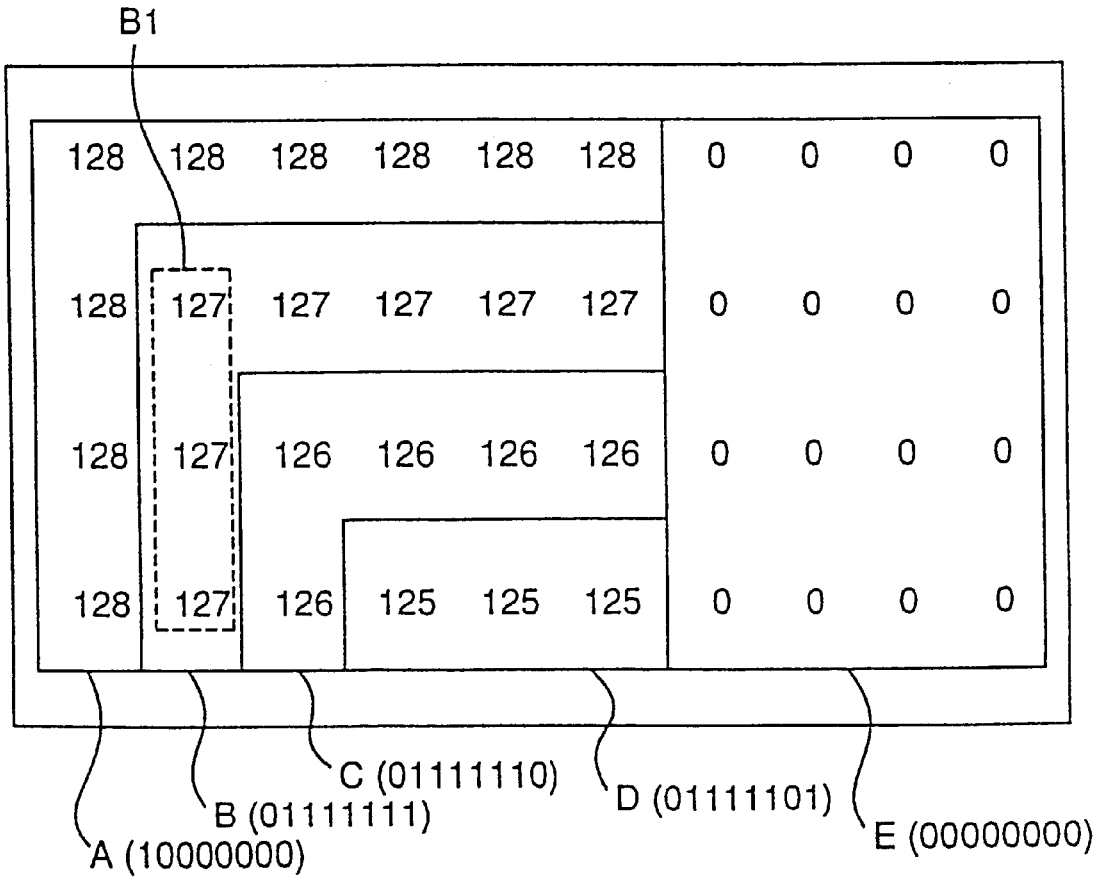
FIG. 3 shows a diagram of an example of PDP screen brightness distribution.
Figure 4:
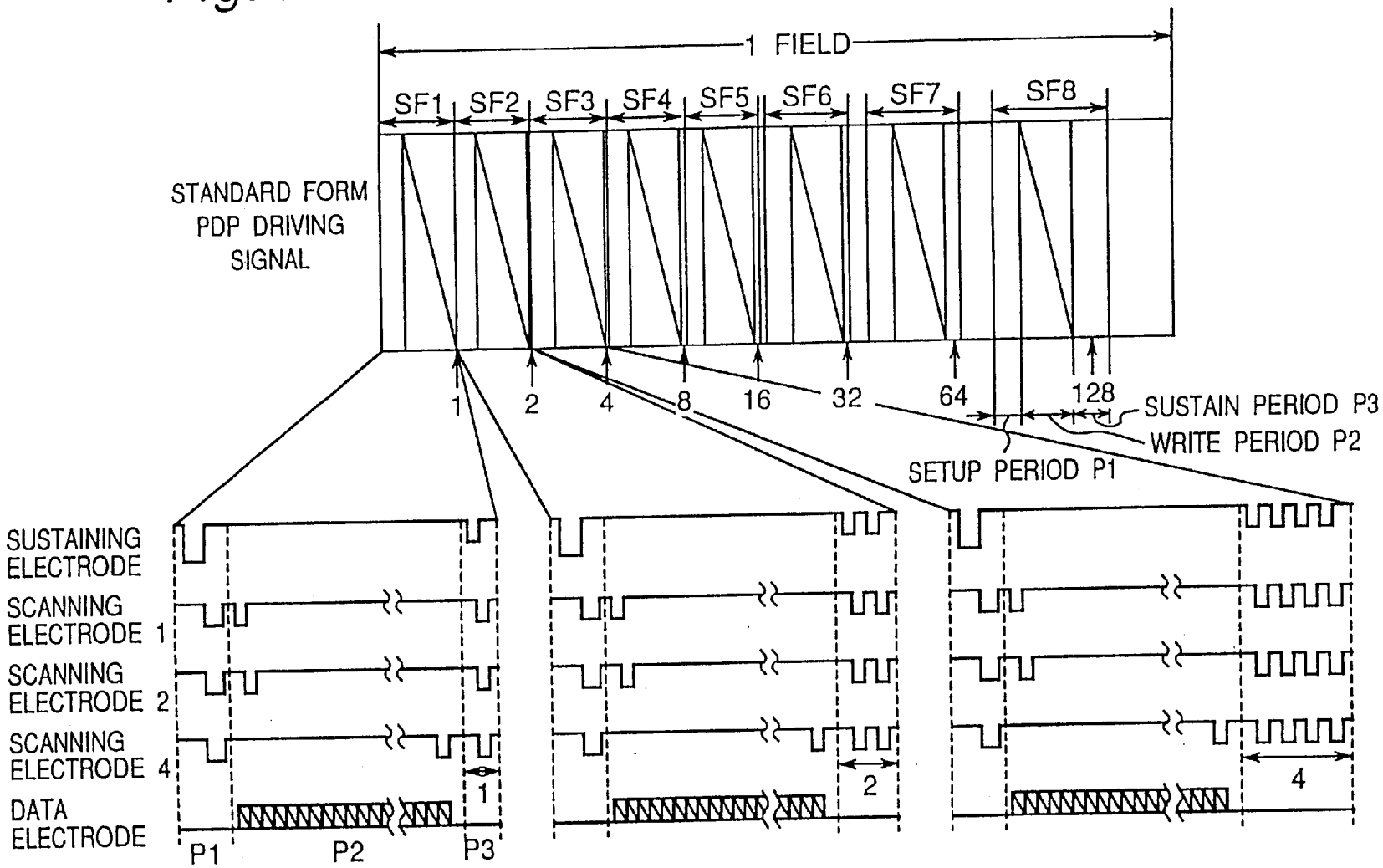
FIG. 4 shows a waveform diagram showing the standard form of a PDP driving signal.
Figure 5:
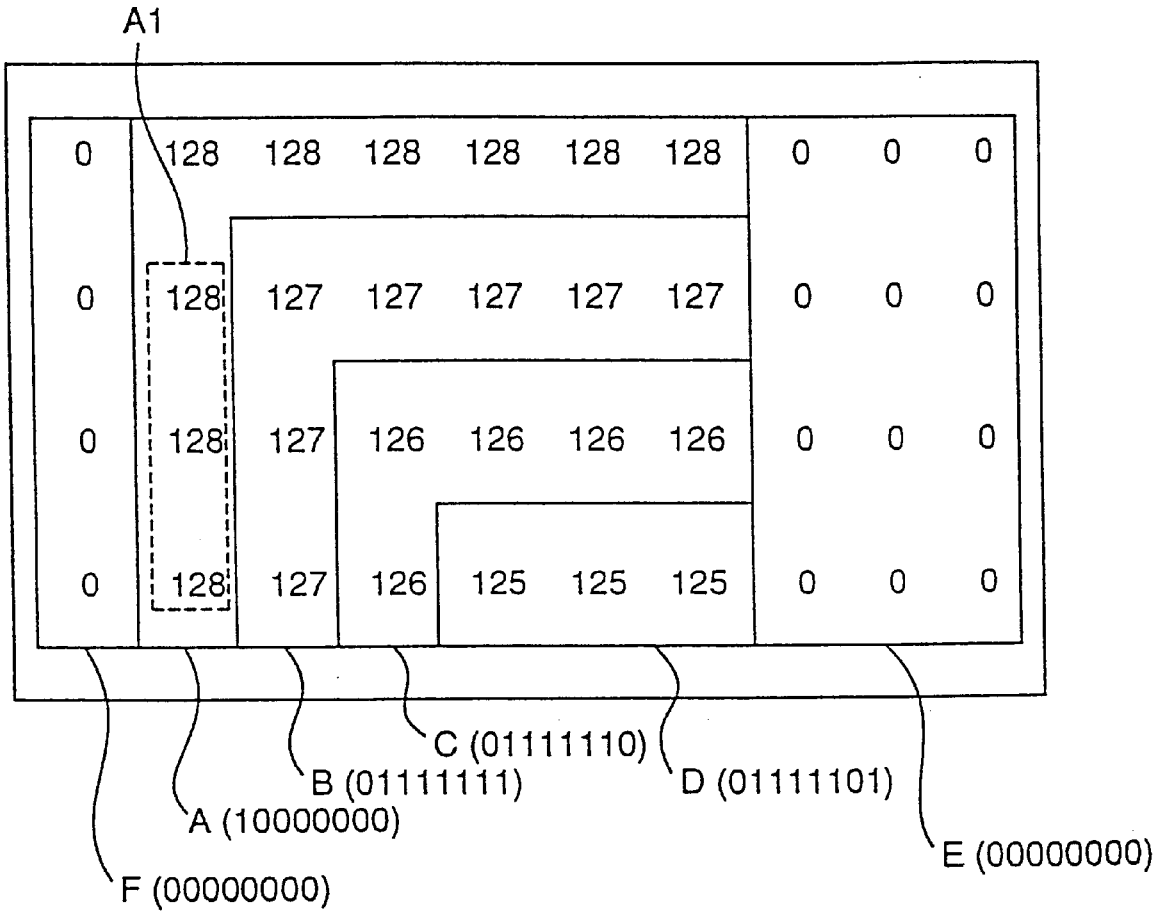
FIG. 5 shows a diagram similar to FIG. 3, but particularly showing a case in which 1 pixel moved from the PDP screen brightness distribution of FIG. 3.

Prior to explaining the embodiments of the present invention, a number of variations of the standard form of a PDP driving signal depicted in FIG. 4 are described.

Figures 6A, 6B:
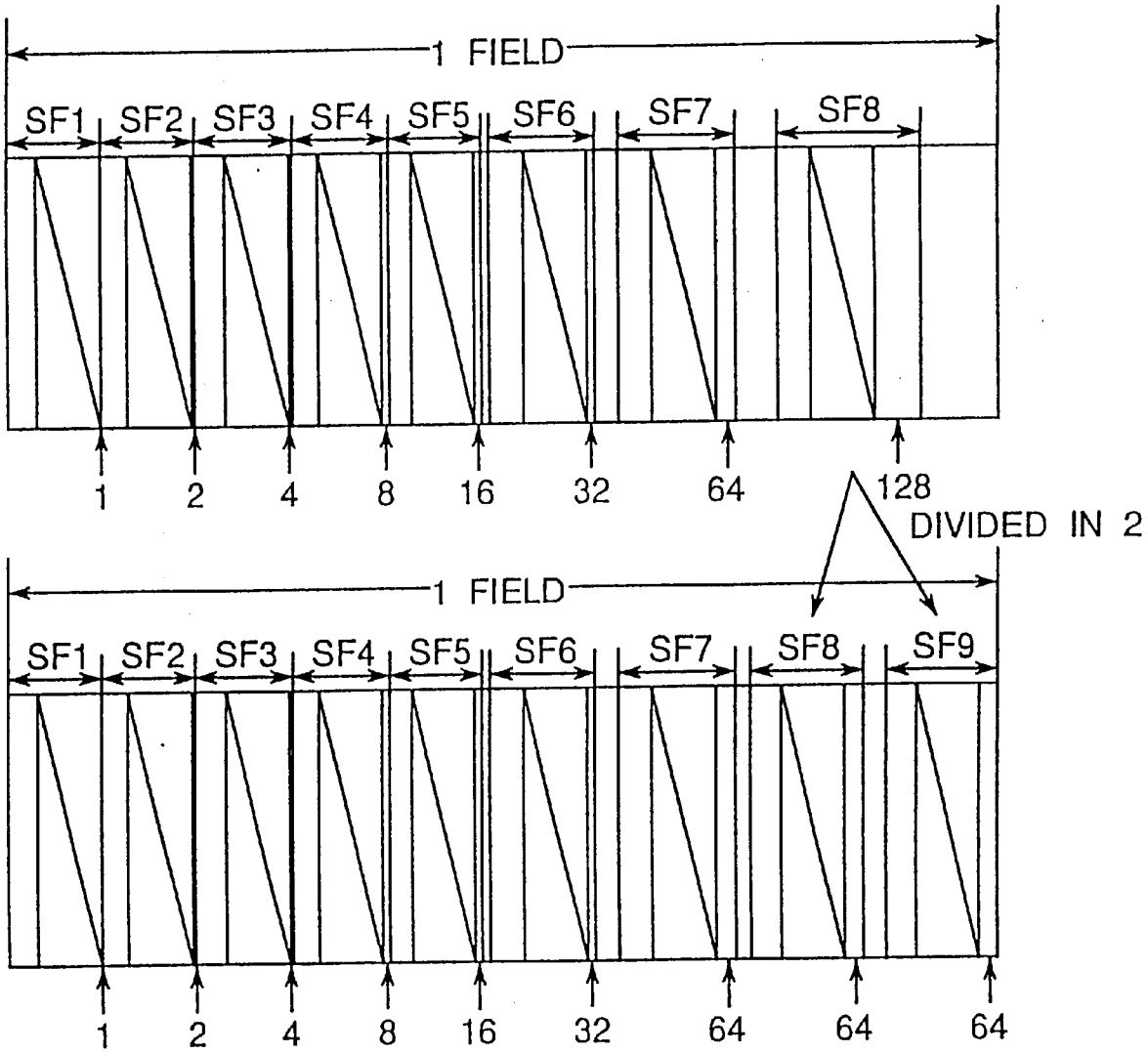
FIGS. 6A and 6B show waveform diagrams showing a 1-times mode of a PDP driving signal with two different subfield numbers.

FIG. 6(A) shows a standard form PDP driving signal, and FIG. 6(B) shows a variation of a PDP driving signal, to which 1 subfield has been added, and which has subfields SF1 through SF9. For the standard form in FIG. 6(A), the final subfield SF8 is weighted by 128 sustaining pulses, and for the variation in FIG. 6(B), each of the last 2 subfields SF8, SF9 are weighted by 64 sustaining pulses. For example, when a brightness level of 130 is to be displayed, with the standard form in FIG. 6(A), this can be achieved using both subfield SF2 (weighted 2) and subfield SF8 (weighted 128), whereas with the variation in FIG. 6(B), this brightness level can be achieved using 3 subfields, subfield SF2 (weighted 2), subfield SF8 (weighted 64), and subfield SF9 (weighted 64). By increasing the number of subfields in this way, it is possible to decrease the weight of the subfield with the greatest weight. Decreasing the weight like this enables pseudo-contour noise to be decreased by that much.

Figure 7:
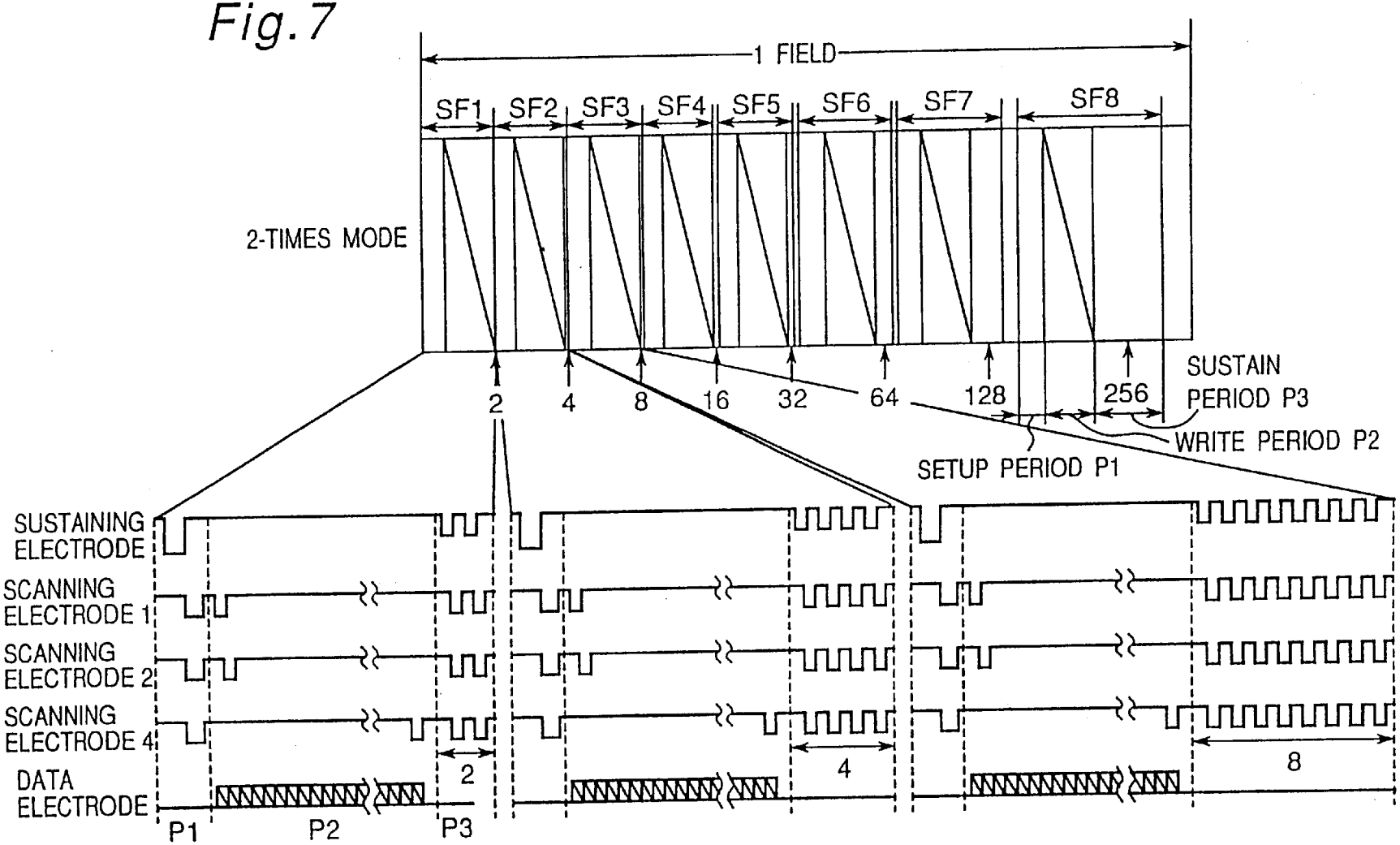
FIG. 7 shows a waveform diagram showing a 2-times mode of a PDP driving signal.

FIG. 7 shows a 2-times mode PDP driving signal. Furthermore, the PDP driving signal shown in FIG. 4 is a 1-times mode. With the 1-times mode in FIG. 4, the number of sustaining pulses contained in the sustain periods P3 for subfields SF1 through SF8, that is, the weighting values, were 1, 2, 4, 8, 16, 32, 64, 128, respectively, but with the 2-times mode in FIG. 7, the number of sustaining pulses contained in the sustain periods P3 for subfields SF1 through SF8 are 2, 4, 8, 16, 32, 64, 128, 256, respectively, doubling for all subfields. In accordance with this, compared to a standard form PDP driving signal, which is a 1-times mode, a 2-times mode PDP driving signal can produce an image display with 2 times the brightness.

Figure 8:
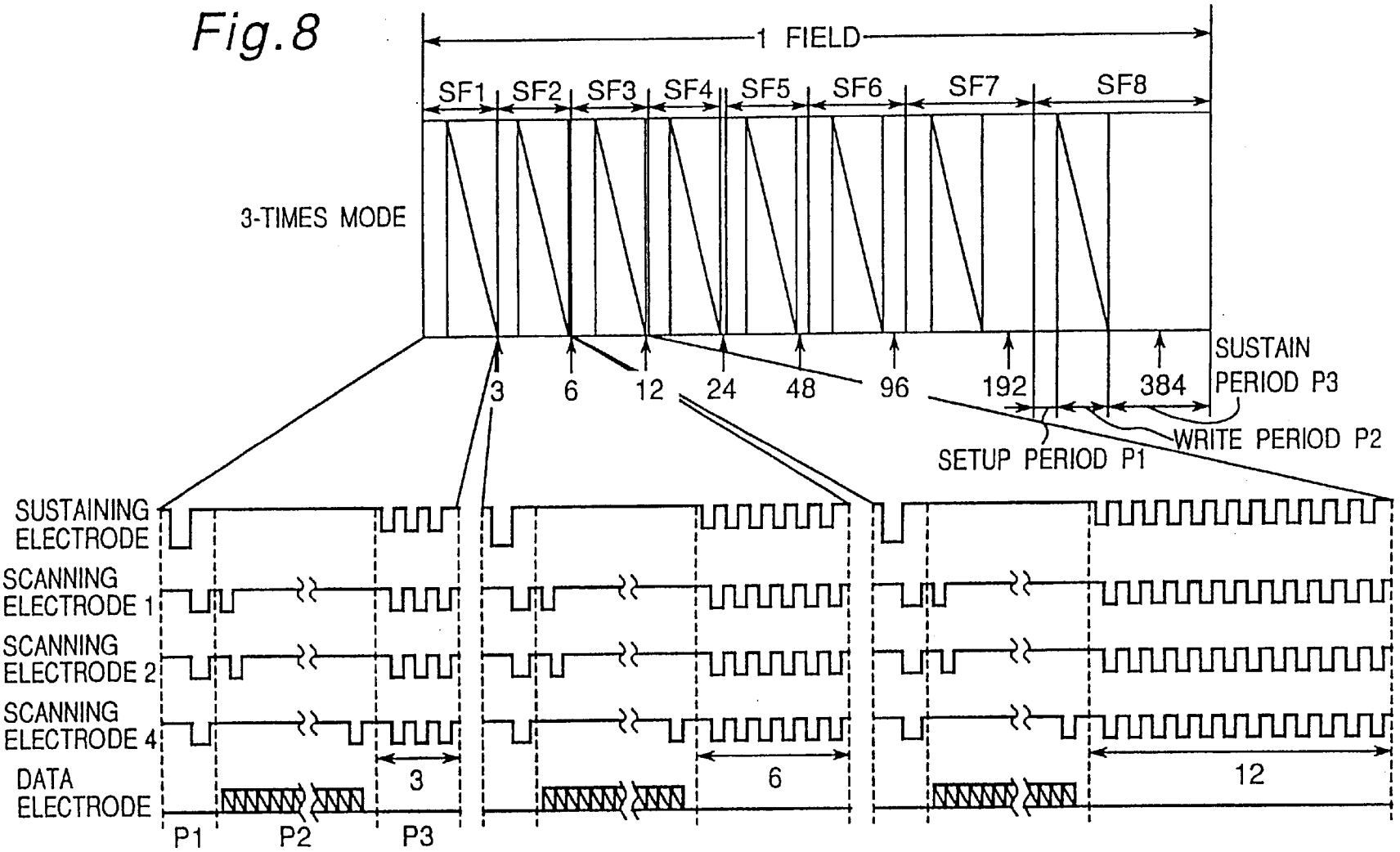
FIG. 8 show a waveform diagram showing a 3-times mode of a PDP driving signal.

FIG. 8 shows a 3-times mode PDP driving signal. Therefore, the number of sustaining pulses contained in the sustain periods P3 for subfields SF1 through SF8 are 3, 6, 12, 24, 48, 96, 192, 384, respectively, tripling for all subfields.

In this way, although dependent on the degree of margin in 1 field, the total number of gradations is 256 gradations, and it is possible to create a maximum 6-times mode PDP driving signal. In accordance with this, it is possible to produce an image display with 6 times the brightness.

Table 1, Table 2, Table 3, Table 4, Table 5, Table 6 shown below are a 1-times mode weighting table, a 2-times mode weighting table, a 3-times mode weighting table, a 4-times mode weighting table, a 5-times mode weighting table, and a 6-times mode weighting table, respectively, for when the subfield number is changed in stages from 8 to 14.

TABLE 1

1-Times Mode Weighting Table

| Number of Subfields | Number of Pulses (Weight) in Each Subfield | | | | | | | | | | | | | | |
|---|---|---|---|---|---|---|---|---|---|---|---|---|---|---|---|
| | SF1 | SF2 | SF3 | SF4 | SF5 | SF6 | SF7 | SF8 | SF9 | SF10 | SF11 | SF12 | SF13 | SF14 | Total |
| 8 | 1 | 2 | 4 | 8 | 16 | 32 | 64 | 128 | — | — | — | — | — | — | 255 |
| 9 | 1 | 2 | 4 | 8 | 16 | 32 | 64 | 64 | 64 | — | — | — | — | — | 255 |
| 10 | 1 | 2 | 4 | 8 | 16 | 32 | 48 | 48 | 48 | 48 | — | — | — | — | 255 |
| 11 | 1 | 2 | 4 | 8 | 16 | 32 | 39 | 39 | 39 | 39 | 36 | — | — | — | 255 |
| 12 | 1 | 2 | 4 | 8 | 16 | 32 | 32 | 32 | 32 | 32 | 32 | 32 | — | — | 255 |
| 13 | 1 | 2 | 4 | 8 | 16 | 28 | 28 | 28 | 28 | 28 | 28 | 28 | 28 | — | 255 |
| 14 | 1 | 2 | 4 | 8 | 16 | 25 | 25 | 25 | 25 | 25 | 25 | 25 | 25 | 24 | 255 |

TABLE 2

2-Times Mode Weighting Table

| Number of Subfields | Number of Pulses (Weight) in Each Subfield | | | | | | | | | | | | | | |
|---|---|---|---|---|---|---|---|---|---|---|---|---|---|---|---|
| | SF1 | SF2 | SF3 | SF4 | SF5 | SF6 | SF7 | SF8 | SF9 | SF10 | SF11 | SF12 | SF13 | SF14 | Total |
| 8 | 2 | 4 | 8 | 16 | 32 | 64 | 128 | 256 | — | — | — | — | — | — | 510 |
| 9 | 2 | 4 | 6 | 16 | 32 | 64 | 128 | 128 | 128 | — | — | — | — | — | 510 |
| 10 | 2 | 4 | 8 | 16 | 32 | 64 | 96 | 96 | 96 | 96 | — | — | — | — | 510 |
| 11 | 2 | 4 | 8 | 16 | 32 | 64 | 78 | 78 | 78 | 78 | 72 | — | — | — | 510 |
| 12 | 2 | 4 | 8 | 16 | 32 | 64 | 64 | 64 | 64 | 64 | 64 | 64 | — | — | 510 |
| 13 | 2 | 4 | 8 | 16 | 32 | 56 | 56 | 56 | 56 | 56 | 56 | 56 | 56 | — | 510 |
| 14 | 2 | 4 | 8 | 16 | 32 | 50 | 50 | 50 | 50 | 50 | 50 | 50 | 50 | 48 | 510 |

TABLE 3

3-Times Mode Weighting Table

| Number of Subfields | Number of Pulses (Weight) in Each Subfield | | | | | | | | | | | | | | |
|---|---|---|---|---|---|---|---|---|---|---|---|---|---|---|---|
| | SF1 | SF2 | SF3 | SF4 | SF5 | SF6 | SF7 | SF8 | SF9 | SF10 | SF11 | SF12 | SF13 | SF14 | Total |
| 8 | 3 | 6 | 12 | 24 | 48 | 96 | 192 | 384 | — | — | — | — | — | — | 765 |
| 9 | 3 | 6 | 12 | 24 | 48 | 96 | 192 | 192 | 192 | — | — | — | — | — | 765 |
| 10 | 3 | 6 | 12 | 24 | 48 | 96 | 144 | 144 | 144 | 144 | — | — | — | — | 765 |
| 11 | 3 | 6 | 12 | 24 | 48 | 96 | 117 | 117 | 117 | 117 | 108 | — | — | — | 765 |
| 12 | 3 | 6 | 12 | 24 | 48 | 96 | 96 | 96 | 96 | 96 | 96 | 96 | — | — | 765 |
| 13 | 3 | 6 | 12 | 24 | 48 | 84 | 84 | 84 | 84 | 84 | 84 | 84 | 84 | — | 765 |
| 14 | 3 | 6 | 12 | 24 | 48 | 75 | 75 | 75 | 75 | 75 | 75 | 75 | 75 | 72 | 765 |

TABLE 4

4-Times Mode Weighting Table

| Number of Subfields | Number of Pulses (Weight) in Each Subfield | | | | | | | | | | | | | | |
|---|---|---|---|---|---|---|---|---|---|---|---|---|---|---|---|
| | SF1 | SF2 | SF3 | SF4 | SF5 | SF6 | SF7 | SF8 | SF9 | SF10 | SF11 | SF12 | SF13 | SF14 | Total |
| 8 | 4 | 8 | 16 | 32 | 64 | 128 | 256 | 512 | — | — | — | — | — | — | 1020 |
| 9 | 4 | 8 | 16 | 32 | 64 | 128 | 256 | 256 | 256 | — | — | — | — | — | 1020 |
| 10 | 4 | 8 | 16 | 32 | 64 | 128 | 192 | 192 | 192 | 192 | — | — | — | — | 1020 |
| 11 | 4 | 8 | 16 | 32 | 64 | 128 | 156 | 156 | 156 | 156 | 144 | — | — | — | 1020 |
| 12 | 4 | 6 | 16 | 32 | 64 | 128 | 128 | 128 | 128 | 128 | 128 | 128 | — | — | 1020 |
| 13 | 4 | 8 | 16 | 32 | 64 | 112 | 112 | 112 | 112 | 112 | 112 | 112 | 112 | — | 1020 |
| 14 | 4 | 8 | 16 | 32 | 64 | 100 | 100 | 100 | 100 | 100 | 100 | 100 | 100 | 96 | 1020 |

TABLE 5

5-Times Mode Weighting Table

| Number of Subfields | Number of Pulses (Weight) in Each Subfield | | | | | | | | | | | | | | |
|---|---|---|---|---|---|---|---|---|---|---|---|---|---|---|---|
| | SF1 | SF2 | SF3 | SF4 | SF5 | SF6 | SF7 | SF8 | SF9 | SF10 | SF11 | SF12 | SF13 | SF14 | Total |
| 8 | 5 | 10 | 20 | 40 | 80 | 160 | 320 | 640 | — | — | — | — | — | — | 1275 |
| 9 | 5 | 10 | 20 | 40 | 80 | 160 | 320 | 320 | 320 | — | — | — | — | — | 1275 |
| 10 | 5 | 10 | 20 | 40 | 80 | 160 | 240 | 240 | 240 | 240 | — | — | — | — | 1275 |
| 11 | 5 | 10 | 20 | 40 | 80 | 160 | 195 | 195 | 195 | 195 | 180 | — | — | — | 1275 |
| 12 | 5 | 10 | 20 | 40 | 80 | 160 | 160 | 160 | 160 | 160 | 160 | 160 | — | — | 1275 |
| 13 | 5 | 10 | 20 | 40 | 80 | 140 | 140 | 140 | 140 | 140 | 140 | 140 | 140 | — | 1275 |
| 14 | 5 | 10 | 20 | 40 | 80 | 125 | 125 | 125 | 125 | 125 | 125 | 125 | 125 | 120 | 1275 |

TABLE 6

6-Times Mode Weighting Table

| Number of Subfields | Number of Pulses (Weight) in Each Subfield | | | | | | | | | | | | | | |
|---|---|---|---|---|---|---|---|---|---|---|---|---|---|---|---|
| | SF1 | SF2 | SF3 | SF4 | SF5 | SF6 | SF7 | SF8 | SF9 | SF10 | SF11 | SF12 | SF13 | SF14 | Total |
| 8 | 6 | 12 | 24 | 48 | 96 | 192 | 384 | 768 | — | — | — | — | — | — | 1530 |
| 9 | 6 | 12 | 24 | 48 | 96 | 192 | 384 | 384 | 384 | — | — | — | — | — | 1530 |
| 10 | 6 | 12 | 24 | 48 | 96 | 192 | 288 | 288 | 288 | 288 | — | — | — | — | 1530 |
| 11 | 6 | 12 | 24 | 48 | 96 | 192 | 234 | 234 | 234 | 234 | 216 | — | — | — | 1530 |
| 12 | 6 | 12 | 24 | 48 | 96 | 192 | 192 | 192 | 192 | 192 | 192 | 192 | — | — | 1530 |
| 13 | 6 | 12 | 24 | 48 | 96 | 168 | 168 | 168 | 168 | 168 | 168 | 168 | 168 | — | 1530 |
| 14 | 6 | 12 | 24 | 48 | 96 | 150 | 150 | 150 | 150 | 150 | 150 | 150 | 150 | 144 | 1530 |

The way to read these tables is as follows. For example, in Table 1, it is a 1-times mode, and when viewing the row, in which the subfield number is 12, the table indicates that the weighting of subfields SF1 through SF12, respectively, are 1, 2, 4, 8, 16, 32, 32, 32, 32, 32, 32, 32. In accordance with this, the maximum weight is kept at 32. Further, in Table 3, it is a 3-times mode, and the row in which the subfield number is 12 constitutes weighting that is 3 times the above-mentioned values, that is 3, 6, 12, 24, 48, 96, 96, 96, 96, 96, 96.

Table 7, Table 8, Table 9, Table 10, Table 11, Table 12, Table 13 shown below indicate which subfield should perform a plasma discharge light emission in each gradation, when the total number of gradations is 256, when the respective subfield numbers are 8, 9, 10, 11, 12, 13, 14.

TABLE 7

Eight Subfields

| Subfield No. | ○: Active Subfield | | | | | | | |
|---|---|---|---|---|---|---|---|---|
| | SF1 | SF2 | SF3 | SF4 | SF5 | SF6 | SF7 | SF8 |
| Gradation\ Number of Pulses | 1 | 2 | 4 | 8 | 16 | 32 | 64 | 128 |
| 0 | | | | | | | | |
| 1 | ○ | | | | | | | |
| 2 | | ○ | | | | | | |
| 3 | ○ | ○ | | | | | | |
| 4 | | | ○ | | | | | |
| 5 | ○ | | ○ | | | | | |
| 6 | | ○ | ○ | | | | | |
| 7 | ○ | ○ | ○ | | | | | |
| 8–15 | Ditto to 0–7 | | | ○ | | | | |
| 16–31 | Ditto to 0–15 | | | | ○ | | | |
| 32–63 | Ditto to 0–31 | | | | | ○ | | |
| 64–127 | Ditto to 0–63 | | | | | | ○ | |
| 128–255 | Ditto to 0–127 | | | | | | | ○ |

TABLE 8

Nine Subfields

| Subfield | ○: Active Subfield | | | | | | | | |
|---|---|---|---|---|---|---|---|---|---|
| No. | SF1 | SF2 | SF3 | SF4 | SF5 | SF6 | SF7 | SF8 | SF9 |
| Gradation\ Number of Pulses | 1 | 2 | 4 | 8 | 16 | 32 | 64 | 64 | 64 |
| 0 | | | | | | | | | |
| 1 | ○ | | | | | | | | |
| 2 | | ○ | | | | | | | |
| 3 | ○ | ○ | | | | | | | |
| 4 | | | ○ | | | | | | |
| 5 | ○ | | ○ | | | | | | |
| 6 | | ○ | ○ | | | | | | |
| 7 | ○ | ○ | ○ | | | | | | |
| 8–15 | Ditto to 0–7 | | | ○ | | | | | |
| 16–31 | Ditto to 0–15 | | | | ○ | | | | |
| 32–63 | Ditto to 0–31 | | | | | ○ | | | |
| 64–127 | Ditto to 0–63 | | | | | | ○ | | |
| 128–191 | Ditto to 0–63 | | | | | | ○ | ○ | |
| 192–255 | Ditto to 0–63 | | | | | | ○ | ○ | ○ |

TABLE 9

Ten Subfields

| Subfield | ○: Active Subfield | | | | | | | | | |
|---|---|---|---|---|---|---|---|---|---|---|
| No. | SF1 | SF2 | SF3 | SF4 | SF5 | SF6 | SF7 | SF8 | SF9 | SF10 |
| Gradation\ Number of Pulses | 1 | 2 | 4 | 8 | 16 | 32 | 48 | 48 | 48 | 48 |
| 0 | | | | | | | | | | |
| 1 | ○ | | | | | | | | | |
| 2 | | ○ | | | | | | | | |
| 3 | ○ | ○ | | | | | | | | |
| 4 | | | ○ | | | | | | | |
| 5 | ○ | ○ | | | | | | | | |
| 6 | | ○ | ○ | | | | | | | |
| 7 | ○ | ○ | ○ | | | | | | | |
| 8–15 | Ditto to 0–7 | | | ○ | | | | | | |
| 16–31 | Ditto to 0–15 | | | | ○ | | | | | |
| 32–63 | Ditto to 0–31 | | | | | ○ | | | | |
| 64–111 | Ditto to 16–63 | | | | | | ○ | | | |
| 112–159 | Ditto to 16–63 | | | | | | ○ | ○ | | |
| 160–207 | Ditto to 16–63 | | | | | | ○ | ○ | ○ | |
| 208–255 | Ditto to 16–63 | | | | | | ○ | ○ | ○ | ○ |

TABLE 10

Eleven Subfields

| Subfield | ○: Active Subfield | | | | | | | | | | |
|---|---|---|---|---|---|---|---|---|---|---|---|
| No. | SF1 | SF2 | SF3 | SF4 | SF5 | SF6 | SF7 | SF8 | SF9 | SF10 | SF11 |
| Gradation\ Number of Pulses | 1 | 2 | 4 | 8 | 16 | 32 | 39 | 39 | 39 | 39 | 36 |
| 0 | | | | | | | | | | | |
| 1 | ○ | | | | | | | | | | |
| 2 | | ○ | | | | | | | | | |

TABLE 10-continued

| Eleven Subfields | | | | | | | | | | | |
|---|---|---|---|---|---|---|---|---|---|---|---|
| Subfield | ○: Active Subfield | | | | | | | | | | |
| No. | SF1 | SF2 | SF3 | SF4 | SF5 | SF6 | SF7 | SF8 | SF9 | SF10 | SF11 |
| Gradation\ Number of Pulses | 1 | 2 | 4 | 8 | 16 | 32 | 39 | 39 | 39 | 39 | 36 |
| 3 | ○ | ○ | | | | | | | | | |
| 4 | | | ○ | | | | | | | | |
| 5 | ○ | | ○ | | | | | | | | |
| 6 | | ○ | ○ | | | | | | | | |
| 7 | ○ | ○ | ○ | | | | | | | | |
| 8–15 | Ditto to 0–7 | | | ○ | | | | | | | |
| 16–31 | Ditto to 0–15 | | | | ○ | | | | | | |
| 32–63 | Ditto to 0–31 | | | | | ○ | | | | | |
| 64–102 | Ditto to 25–63 | | | | | | ○ | | | | |
| 103–141 | Ditto to 25–63 | | | | | | ○ | ○ | | | |
| 142–180 | Ditto to 25–63 | | | | | | ○ | ○ | ○ | | |
| 181–244 | Ditto to 25–63 | | | | | | ○ | ○ | ○ | ○ | |
| 245–255 | Ditto to 53–63 | | | | | | ○ | ○ | ○ | ○ | ○ |

TABLE 11

| Twelve Subfields | | | | | | | | | | | | |
|---|---|---|---|---|---|---|---|---|---|---|---|---|
| Subfield | ○: Active Subfield | | | | | | | | | | | |
| No. | SF1 | SF2 | SF3 | SF4 | SF5 | SF6 | SF7 | SF8 | SF9 | SF10 | SF11 | SF12 |
| Gradation\ Number of Pulses | 1 | 2 | 4 | 8 | 16 | 32 | 32 | 32 | 32 | 32 | 32 | 32 |
| 0 | | | | | | | | | | | | |
| 1 | ○ | | | | | | | | | | | |
| 2 | | ○ | | | | | | | | | | |
| 3 | ○ | ○ | | | | | | | | | | |
| 4 | | | ○ | | | | | | | | | |
| 5 | ○ | | ○ | | | | | | | | | |
| 6 | | ○ | ○ | | | | | | | | | |
| 7 | ○ | ○ | ○ | | | | | | | | | |
| 8–15 | Ditto to 0–7 | | | ○ | | | | | | | | |
| 16–31 | Ditto to 0–15 | | | | ○ | | | | | | | |
| 32–63 | Ditto to 0–31 | | | | | ○ | | | | | | |
| 64–95 | Ditto to 0–31 | | | | | ○ | ○ | | | | | |
| 96–127 | Ditto to 0–31 | | | | | ○ | ○ | ○ | | | | |
| 128–159 | Ditto to 0–31 | | | | | ○ | ○ | ○ | ○ | | | |
| 160–191 | Ditto to 0–31 | | | | | ○ | ○ | ○ | ○ | ○ | | |
| 192–223 | Ditto to 0–31 | | | | | ○ | ○ | ○ | ○ | ○ | ○ | |
| 224–255 | Ditto to 0–31 | | | | | ○ | ○ | ○ | ○ | ○ | ○ | ○ |

TABLE 12

| Thirteen Subfields | | | | | | | | | | | | | |
|---|---|---|---|---|---|---|---|---|---|---|---|---|---|
| Subfield | ○: Active Subfield | | | | | | | | | | | | |
| No. | SF1 | SF2 | SF3 | SF4 | SF5 | SF6 | SF7 | SF8 | SF9 | SF10 | SF11 | SF12 | SF13 |
| Gradation\ Number of Pulses | 1 | 2 | 4 | 8 | 16 | 28 | 28 | 28 | 28 | 28 | 28 | 28 | 28 |
| 0 | | | | | | | | | | | | | |
| 1 | ○ | | | | | | | | | | | | |
| 2 | | ○ | | | | | | | | | | | |
| 3 | ○ | ○ | | | | | | | | | | | |
| 4 | | | ○ | | | | | | | | | | |
| 5 | ○ | | ○ | | | | | | | | | | |
| 6 | | ○ | ○ | | | | | | | | | | |
| 7 | ○ | ○ | ○ | | | | | | | | | | |

TABLE 12-continued

| Subfield | Thirteen Subfields ○: Active Subfield | | | | | | | | | | | | |
|---|---|---|---|---|---|---|---|---|---|---|---|---|---|
| No. | SF1 | SF2 | SF3 | SF4 | SF5 | SF6 | SF7 | SF8 | SF9 | SF10 | SF11 | SF12 | SF13 |
| Gradation\ Number of Pulses | 1 | 2 | 4 | 8 | 16 | 28 | 28 | 28 | 28 | 28 | 28 | 28 | 28 |
| 8–15 | Ditto to 0–7 | | | ○ | | | | | | | | | |
| 16–31 | Ditto to 0–15 | | | | ○ | | | | | | | | |
| 32–59 | | Ditto to 4–31 | | | | ○ | | | | | | | |
| 60–87 | | Ditto to 4–31 | | | | ○ | ○ | | | | | | |
| 88–115 | | Ditto to 4–31 | | | | ○ | ○ | ○ | | | | | |
| 116–143 | | Ditto to 4–31 | | | | ○ | ○ | ○ | ○ | | | | |
| 144–171 | | Ditto to 4–31 | | | | ○ | ○ | ○ | ○ | ○ | | | |
| 172–199 | | Ditto to 4–31 | | | | ○ | ○ | ○ | ○ | ○ | ○ | | |
| 200–227 | | Ditto to 4–31 | | | | ○ | ○ | ○ | ○ | ○ | ○ | ○ | |
| 228–255 | | Ditto to 4–31 | | | | ○ | ○ | ○ | ○ | ○ | ○ | ○ | ○ |

TABLE 13

| Subfield | Fourteen Subfields ○: Active Subfield | | | | | | | | | | | | | |
|---|---|---|---|---|---|---|---|---|---|---|---|---|---|---|
| No. | SF1 | SF2 | SF3 | SF4 | SF5 | SF6 | SF7 | SF8 | SF9 | SF10 | SF11 | SF12 | SF13 | SF14 |
| Gradation\ Number of Pulses | 1 | 2 | 4 | 8 | 16 | 25 | 25 | 25 | 25 | 25 | 25 | 25 | 25 | 24 |
| 0 | | | | | | | | | | | | | | |
| 1 | ○ | | | | | | | | | | | | | |
| 2 | | ○ | | | | | | | | | | | | |
| 3 | ○ | ○ | | | | | | | | | | | | |
| 4 | | | ○ | | | | | | | | | | | |
| 5 | ○ | | ○ | | | | | | | | | | | |
| 6 | | ○ | ○ | | | | | | | | | | | |
| 7 | ○ | ○ | ○ | | | | | | | | | | | |
| 8–15 | Ditto to 0–7 | | | ○ | | | | | | | | | | |
| 16–31 | Ditto to 0–15 | | | | ○ | | | | | | | | | |
| 32–56 | | Ditto to 7–31 | | | | ○ | | | | | | | | |
| 57–81 | | Ditto to 7–31 | | | | ○ | ○ | | | | | | | |
| 82–106 | | Ditto to 7–31 | | | | ○ | ○ | ○ | | | | | | |
| 107–131 | | Ditto to 7–31 | | | | ○ | ○ | ○ | ○ | | | | | |
| 132–156 | | Ditto to 7–31 | | | | ○ | ○ | ○ | ○ | ○ | | | | |
| 157–181 | | Ditto to 7–31 | | | | ○ | ○ | ○ | ○ | ○ | ○ | | | |
| 182–206 | | Ditto to 7–31 | | | | ○ | ○ | ○ | ○ | ○ | ○ | ○ | | |
| 207–231 | | Ditto to 7–31 | | | | ○ | ○ | ○ | ○ | ○ | ○ | ○ | ○ | |
| 232–255 | | Ditto to 8–31 | | | | ○ | ○ | ○ | ○ | ○ | ○ | ○ | ○ | ○ |

The way to read these tables is as follows. A O indicates an active subfield. In the active subfield, a plasma discharge light emission should be performed to produce a desired gradation level for a certain noticeable pixel. For example, in the subfield number 12 shown in Table 11, since subfields SF2 (weighted 2) and SF3 (weighted 4) can be utilized to produce a level 6 gradation, O is placed in the SF2 and SF3 columns. Furthermore, the light-emitting-frequency in subfield SF2 is 2 times, and the light-emitting-frequency in subfield SF3 is 4 times, so that light is emitted a total of 6 times, enabling the production of a level 6 gradation.

Further, in Table 11, since subfields SF3 (weighted 4), SF6 (weighted 32), SF7 (weighted 32), and SF8 (weighted 32) can be utilized to produce a level 100 gradation, O is placed in the SF3, SF6, SF7 and SF8 columns. Table 7 through Table 14 show only cases of 1-times mode. For N-times mode (N is an integer from 1 to 6), a value that is N times the value of a pulse number can be used.

Figure 9A:
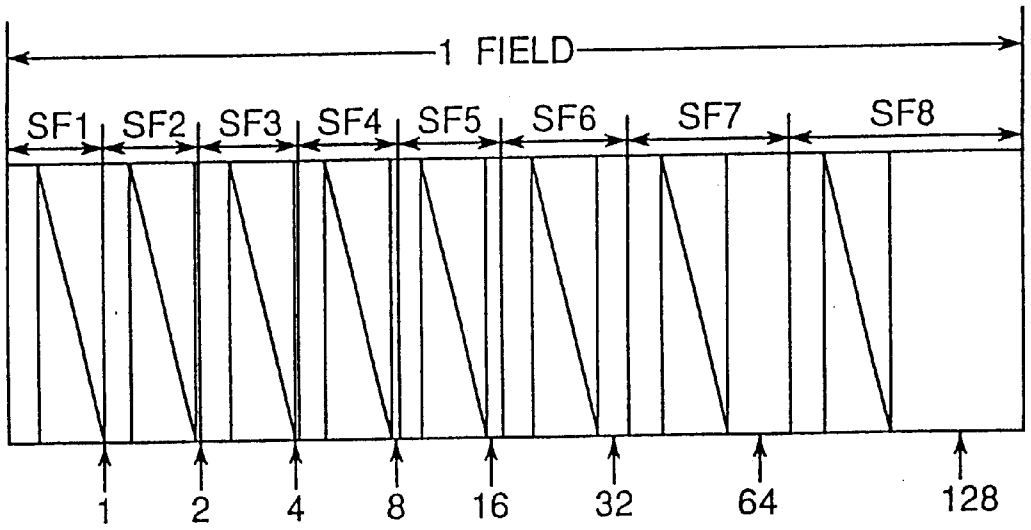
FIGS. 9A and 9B show waveform diagrams of standard forms of PDP driving signal when number of gradations differ.
Figure 9B:
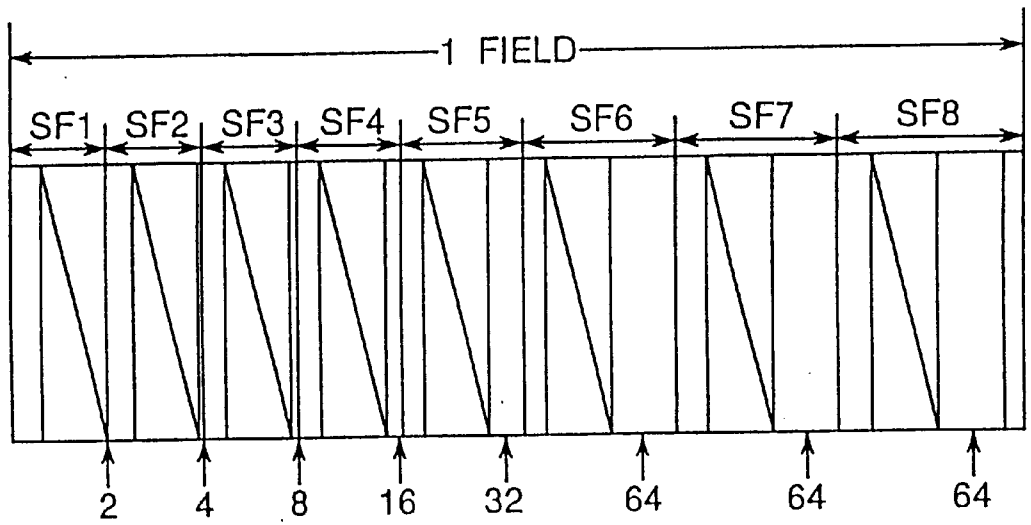

FIG. 9(A) shows a standard form PDP driving signal, and FIG. 9(B) shows a PDP driving signal, when the gradation display points have been reduced, that is, when the level difference is 2 (when the level difference of a standard form is 1). In the case of the standard form in FIG. 9(A), brightness levels from 0 to 255 can be displayed in 1 pitch using 256 different gradation display points (0, 1, 2, 3, 4, 5, . . . , 255). In the case of the variation in FIG. 9(B), brightness levels from 0 to 254 can be displayed in 2 pitches using 128 different gradation display points (0, 2, 4, 6, 8, . . . , 254). By enlarging the level difference (that is, decreasing the number of gradation display points) in this way without changing the number of subfields, the weight of the subfield with the greatest weight can be reduced, and as a result, pseudo-contour noise can be reduced.

Table 14, Table 15, Table 16, Table 17, Table 18, Table 19, Table 20 shown below are gradation level difference tables for various subfields, and indicate when the number of gradation display points differ.

TABLE 14

Gradation Level Difference Table for Eight Subfields

| Number of Gradation Display Points | Number of Pulses (Weight) in Each Subfield SF1 | SF2 | SF3 | SF4 | SF5 | SF6 | SF7 | SF8 | Smax |
|---|---|---|---|---|---|---|---|---|---|
| 256 | 1 | 2 | 4 | 8 | 16 | 32 | 64 | 128 | 255 |
| 128 | 2 | 4 | 8 | 16 | 32 | 64 | 64 | 64 | 254 |
| 64 | 4 | 8 | 16 | 32 | 48 | 48 | 48 | 48 | 252 |

TABLE 15

Gradation Level Difference Table for Nine Subfields

| Number of Gradation Display Points | Number of Pulses (Weight) in Each Subfield SF1 | SF2 | SF3 | SF4 | SF5 | SF6 | SF7 | SF8 | SF9 | Smax |
|---|---|---|---|---|---|---|---|---|---|---|
| 256 | 1 | 2 | 4 | 8 | 16 | 32 | 64 | 64 | 64 | 255 |
| 128 | 2 | 4 | 8 | 16 | 32 | 48 | 48 | 48 | 48 | 254 |
| 64 | 4 | 8 | 16 | 32 | 39 | 39 | 39 | 39 | 36 | 252 |

TABLE 16

Gradation Level Difference Table for Ten Subfields

| Number of Gradation Display Points | Number of Pulses (Weight) in Each Subfield SF1 | SF2 | SF3 | SF4 | SF5 | SF6 | SF7 | SF8 | SF9 | SF10 | Smax |
|---|---|---|---|---|---|---|---|---|---|---|---|
| 256 | 1 | 2 | 4 | 8 | 16 | 32 | 48 | 48 | 48 | 48 | 255 |
| 128 | 2 | 4 | 8 | 16 | 32 | 39 | 39 | 39 | 39 | 36 | 254 |
| 64 | 4 | 8 | 16 | 32 | 32 | 32 | 32 | 32 | 32 | 32 | 252 |

TABLE 17

Gradation Level Difference Table for Eleven Subfields

| Number of Gradation Display Points | Number of Pulses (Weight) in Each Subfield SF1 | SF2 | SF3 | SF4 | SF5 | SF6 | SF7 | SF8 | SF9 | SF10 | SF11 | Smax |
|---|---|---|---|---|---|---|---|---|---|---|---|---|
| 256 | 1 | 2 | 4 | 8 | 16 | 32 | 39 | 39 | 39 | 39 | 36 | 255 |
| 128 | 2 | 4 | 8 | 16 | 32 | 32 | 32 | 32 | 32 | 32 | 32 | 254 |
| 64 | 4 | 8 | 16 | 28 | 28 | 28 | 28 | 28 | 28 | 28 | 28 | 252 |

TABLE 18

Gradation Level Difference Table for Twelve Subfields

| Number of Gradation Display Points | Number of Pulses (Weight) in Each Subfield SF1 | SF2 | SF3 | SF4 | SF5 | SF6 | SF7 | SF8 | SF9 | SF10 | SF11 | SF12 | Smax |
|---|---|---|---|---|---|---|---|---|---|---|---|---|---|
| 256 | 1 | 2 | 4 | 8 | 16 | 32 | 32 | 32 | 32 | 32 | 32 | 32 | 255 |
| 128 | 2 | 4 | 8 | 16 | 28 | 28 | 28 | 28 | 28 | 28 | 28 | 28 | 254 |
| 64 | 4 | 8 | 16 | 25 | 25 | 25 | 25 | 25 | 25 | 25 | 25 | 24 | 252 |

TABLE 19

Gradation Level Difference Table for Thirteen Subfields

| Number of Gradation | Number of Pulses (Weight) in Each Subfield | | | | | | | | | | | | | |
|---|---|---|---|---|---|---|---|---|---|---|---|---|---|---|
| Display Points | SF1 | SF2 | SF3 | SF4 | SF5 | SF6 | SF7 | SF8 | SF9 | SF10 | SF11 | SF12 | SF13 | Smax |
| 256 | 1 | 2 | 4 | 8 | 16 | 28 | 28 | 28 | 28 | 28 | 28 | 28 | 28 | 255 |
| 128 | 2 | 4 | 8 | 16 | 25 | 25 | 25 | 25 | 25 | 25 | 25 | 25 | 24 | 254 |
| 64 | 4 | 8 | 16 | 23 | 23 | 23 | 23 | 23 | 23 | 23 | 23 | 23 | 17 | 252 |

TABLE 20

Gradation Level Difference Table for Fourteen Subfields

| Number of Gradation | Number of Pulses (Weight) in Each Subfield | | | | | | | | | | | | | | |
|---|---|---|---|---|---|---|---|---|---|---|---|---|---|---|---|
| Display Points | SF1 | SF2 | SF3 | SF4 | SF5 | SF6 | SF7 | SF8 | SF9 | SF10 | SF11 | SF12 | SF13 | SF14 | Smax |
| 256 | 1 | 2 | 4 | 8 | 16 | 25 | 25 | 25 | 25 | 25 | 25 | 25 | 25 | 24 | 255 |
| 128 | 2 | 4 | 8 | 16 | 23 | 23 | 23 | 23 | 23 | 23 | 23 | 23 | 23 | 17 | 254 |
| 64 | 4 | 8 | 16 | 21 | 21 | 21 | 21 | 21 | 21 | 21 | 21 | 21 | 21 | 14 | 252 |

The way to read these tables is as follows. For example, Table 17 is a gradation level difference table when the subfield number is 11. The first row shows the weight of each subfield when the number of gradation display points is 256, the second row shows the weight of each subfield when the number of gradation display points is 128, and the third row shows the weight of each subfield when the number of gradation display points is 64. Smax, the maximum gradation display points that can be displayed (that is, the maximum possible brightness level), is indicated on the right end.

Figure 10A:
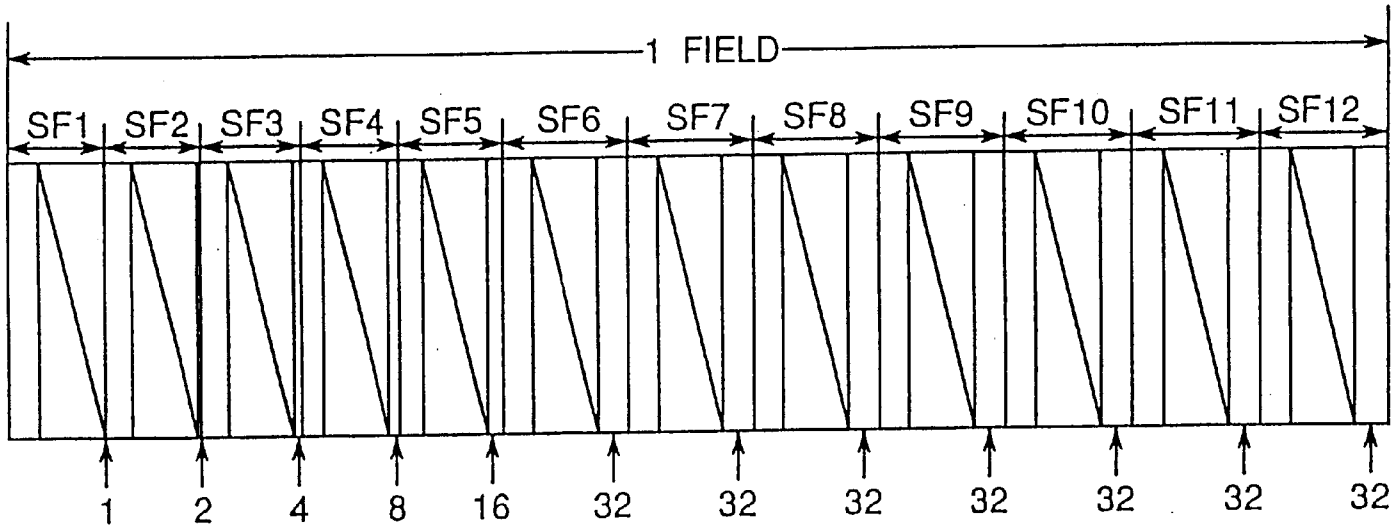
FIGS. 10A and 10B show waveform diagrams of PDP driving signal when vertical synchronizing frequency is 60 Hz and 72 Hz.
Figure 10B:
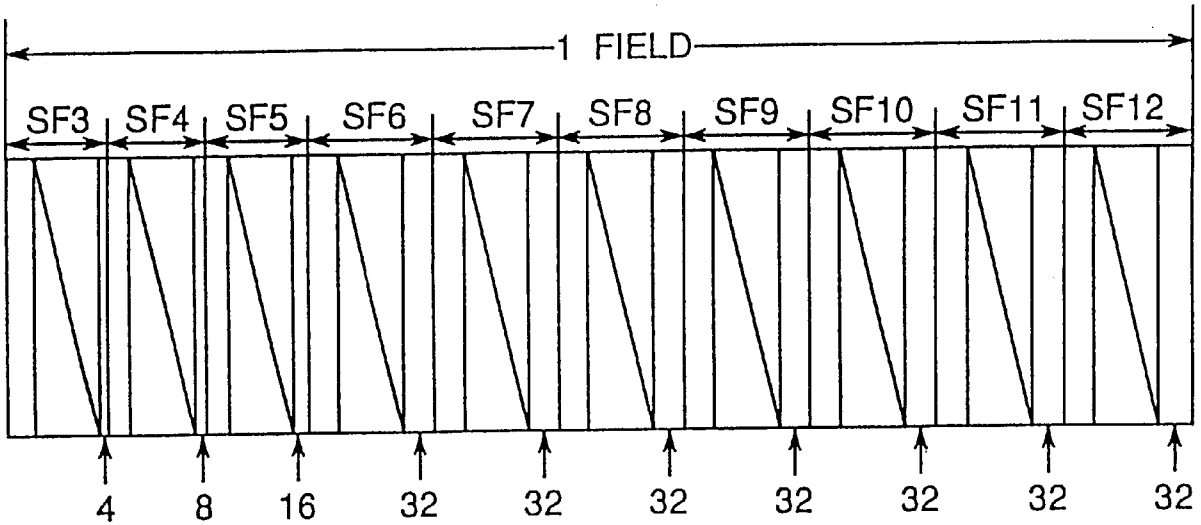

FIG. 10(A) shows a standard form PDP driving signal, and FIG. 10(B) shows a PDP driving signal when the vertical synchronizing frequency is high. For an ordinary television signal, the vertical synchronizing frequency is 60 Hz, but since the vertical synchronizing frequency of a personal computer or other picture signal has a frequency that is higher than 60 Hz, for example, 72 Hz, 1 field time becomes substantially shorter. Meanwhile, since there is no change in the frequency of the signal to the scanning electrode or data electrode for driving a PDP, the number of subfields capable of being introduced into a shortened 1 field time decreases. FIG. 10(B) shows a PDP driving signal when subfields weighted 1 and 2 are eliminated, and the number of subfields is 10.

Next, the preferred embodiments are explained. Table 21 shows various embodiments, and the combination of various characteristics thereof.

TABLE 21

| Emb't: | Peak Detect | Average Detect |
|---|---|---|
| 1st: | x | x |
| 2nd: | x | x (with contrast detect) |
| 3rd: | x | x (with ambient illuminance detect) |
| 4th: | x | x (with power consumption detect) |
| 5th: | x | x (with panel temperature detect) |

First Embodiment

Figure 11:
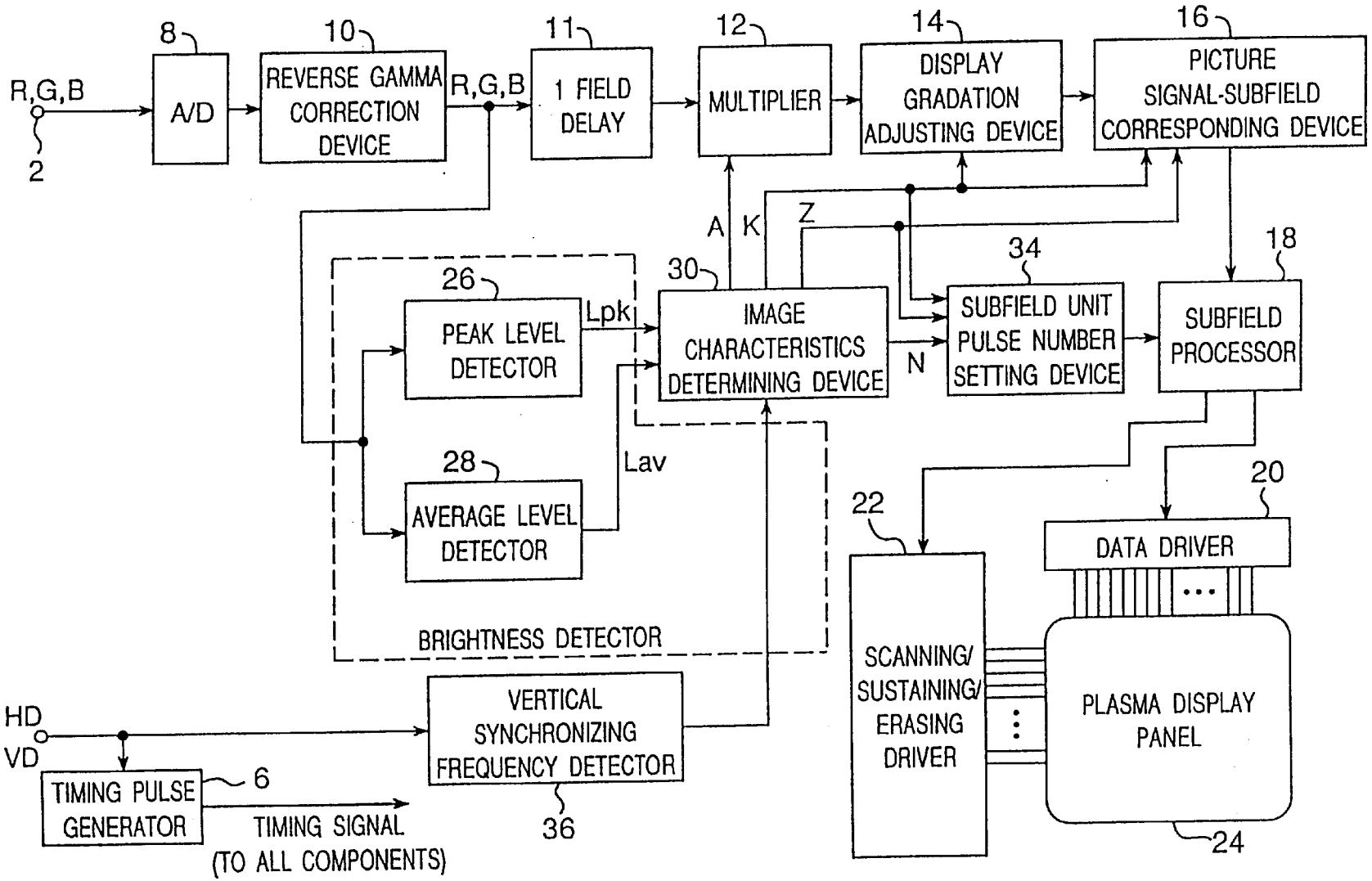
FIG. 11 shows a block diagram of a display apparatus of a first embodiment.

FIG. 11 shows a block diagram of a first embodiment of a display apparatus capable of adjusting the subfield number in accordance with brightness. Input 2 receives R, G, B signals. A vertical synchronizing signal, horizontal synchronizing signal are inputted to a timing pulse generator 6 from input terminals VD, HD, respectively. An A/D converter 8 receives R, G, B signals and performs A/D conversion. A/D converted R, G, B signals undergo reverse gamma correction via a reverse gamma correction device 10. Prior to reverse gamma correction, the level of each of the R, G, B signals, from a minimum 0 to a maximum 255, is displayed in 1 pitch in accordance with an 8-bit signal as 256 linearly different levels (0, 1, 2, 3, 4, 5, . . . , 255). Following reverse gamma correction, the levels of the R, G, B signals, from a minimum 0 to a maximum 255, are each displayed with an accuracy of roughly 0.004 in accordance with a 16-bit signal as 256 non-linearly different levels.

Post-reverse gamma correction R, G, B signals are sent to a 1 field delay 11, and are also sent to a peak level detector 26 and an average level detector 28. A 1 field delayed signal from the 1 field delay 11 is applied to a multiplier 12.

With the peak level detector 26, an R signal peak level Rmax, a G signal peak level Gmax, and a B signal peak level Bmax are detected in data of 1 field, and the peak level Lpk of the Rmax, Gmax and Bmax is also detected. That is, with the peak level detector 26, the brightest value in 1 field is detected. With the average level detector 28, an R signal average value Rav, a G signal average value Gav, and a B signal average value Bav are sought in data of 1 field, and the average level Lav of the Rav, Gav and Bav is also determined. That is, with the average level detector 26, the average value of the brightness in 1 field is determined.

An image characteristic determining device 30 receives the average level Lav and peak level Lpk, and decides 4 parameters by combining the average level with the peak level: N-times mode value N; multiplication factor A of the multiplier 12; number of subfields Z; and number of gradation display points K.

Figure 12:
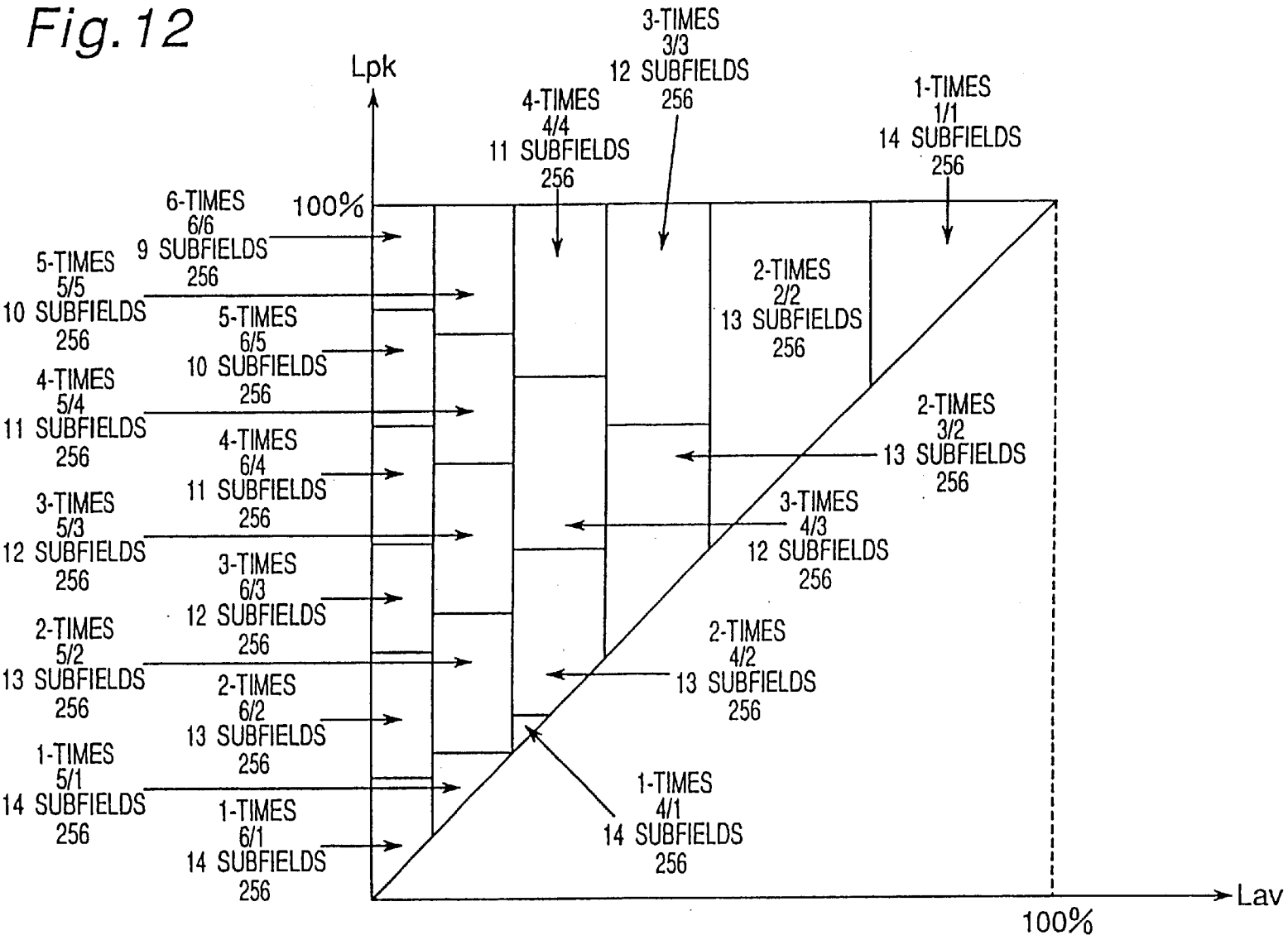
FIG. 12. shows a development schematic map for determining parameters held in image characteristic determining device 30 in the first embodiment.

FIG. 12 is a map for determining parameters used in the first embodiment. The horizontal axis represents the average level Lav, and the vertical axis represents the peak level Lpk. Since the peak level is ordinarily larger than the average level, the map exists only inside the triangular area above the 45( diagonal line. The triangular area is divided by lines parallel to the vertical axis into a plurality of columns, 6 in the case of FIG. 12: C1, C2, C3, C4, C5, C6. Column width is non-uniform, and becomes wider as the average level increases. And the vertical length of the columns is divided by lines parallel to the horizontal axis, creating a plurality of segments. In column C1, 6 segments are formed. In the example in FIG. 12, all together 19 segments are formed. The above-mentioned 4 parameters N, A, Z, K are specified for each segment. In FIG. 12, the 4 numerical values depicted inside each segment indicate the 4 parameters in descending order: N-times mode value N; multiplication factor A of the multiplier 12; number of subfields Z; and number of gradation display points K. The numerical values of the 4 parameters are similarly indicated in maps shown in other figures. The segments can be created using another partitioning method, and the vertical length of a column can also be divided into segments that adjust only 1 of the 4 parameters mentioned above.

As is clear from the map in FIG. 12, the lower the average level Lav, the fewer the number of subfields Z. And the lower the peak level, the greater the number of subfields Z. Further, the lower the average level Lav, the larger the weighting multiplier N. By setting up a map like this, brightness intensity is emphasized, and, as will be explained below, it is possible to produce a sharp, clear image.

For example, the upper-left segment in FIG. 12 is selected for an image, in which the average level Lav is low, and the peak level Lpk is high. Such an image, for example, might be an image, in which a brightly shining star is visible in the night sky. In this upper-left segment, a 6-times mode is employed, the multiplication factor is set at 1, the number of subfields is set at 9, and the number of gradation display points is set at 256. In particular, by setting the weighting multiplier to the 6-times mode, since bright places are highlighted more brightly, a star can be seen as shining more brightly.

Further, the lower-left segment in FIG. 12 is selected for an image, in which the average level Lav is low, and the peak level Lpk is low. Such an image, for example, might be an image of a human form faintly visible on a dark night. In this lower-left segment, a 1-times mode is employed, the multiplication factor is set at 6, the number of subfields is set at 14, and the number of gradation display points is set at 256. In particular, by employing the 1-times mode and setting the multiplication factor at 6, the gradability of low luminance portions improves, and a human form is displayed more clearly.

When the average level is high, since the number of subfields Z can be increased, and the weighting multiplier N can be decreased, it is possible to prevent an increase in power consumption and a rise in panel temperature. Further, by increasing the number of subfields Z, it is also possible to reduce pseudo-contour lines.

When the average level is low, since the number of subfields can be decreased, and the number of writes within 1 field time can be decreased, the temporal margin achieved thereby can be utilized to increase the weighting multiplier N. Therefore, even dark places can be displayed brightly.

When the peak level is high, since the number of subfields Z can be made fewer, and the weighting multiplier N can be increased, artifacts that shine at peak level in an image, for example, the shining of a star in a night sky, can be highlighted more.

Figure 13A:
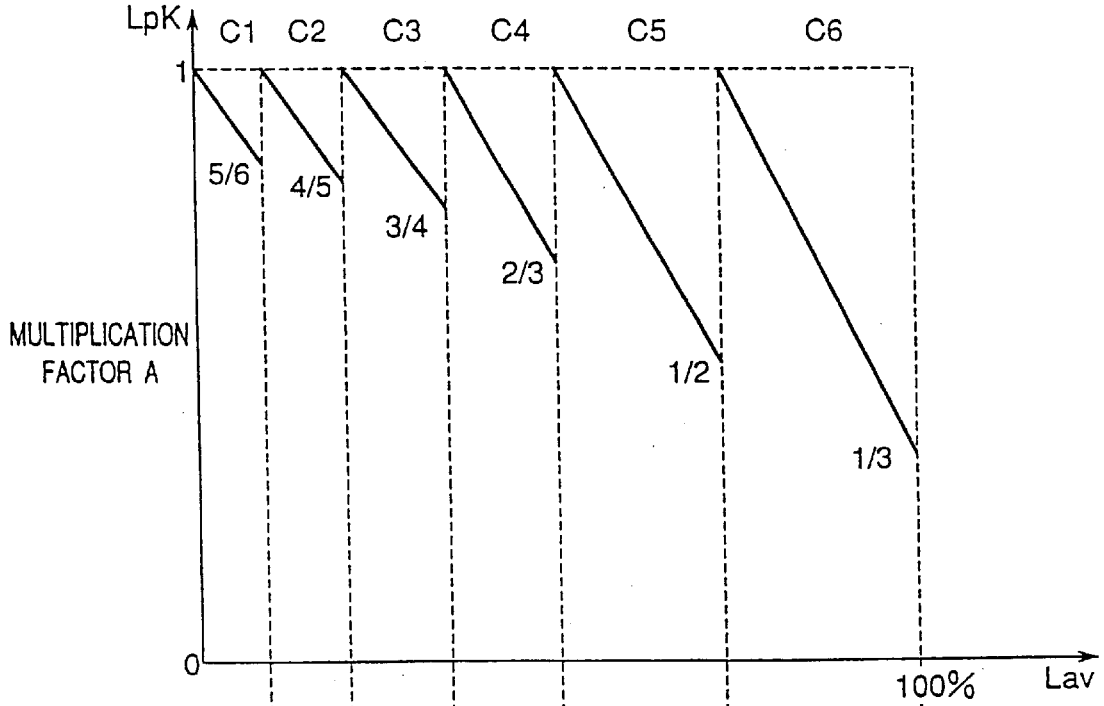
FIGS. 13A and 13B show a development schematic map, showing variation of parameter-determining map shown in FIG. 12.
Figure 13B:
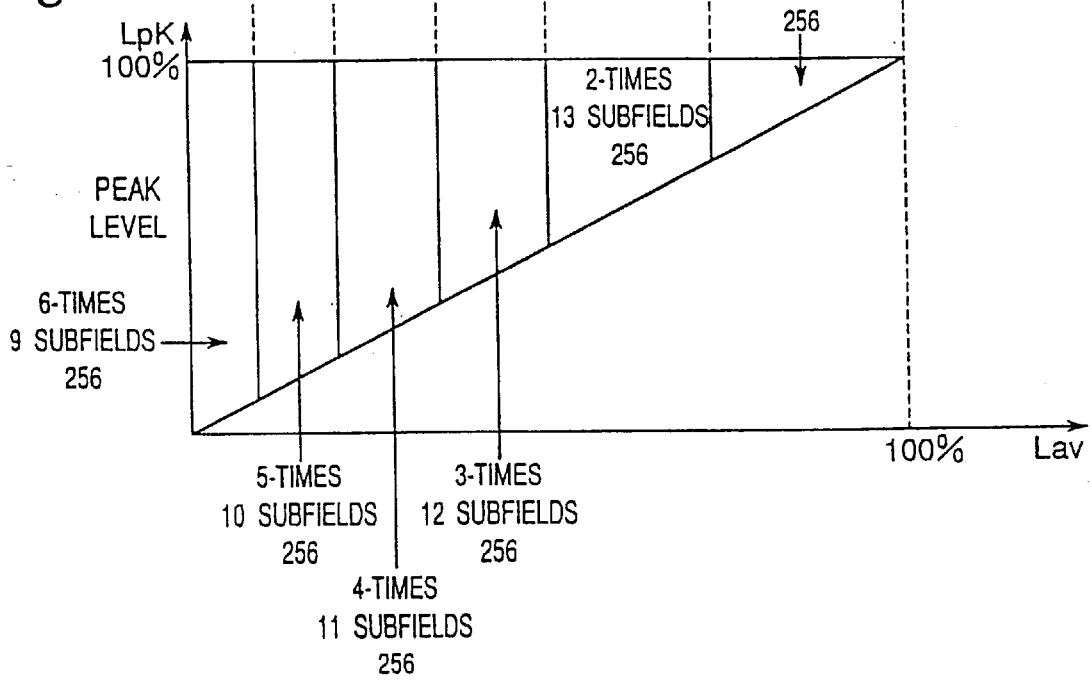

FIG. 13 shows a variation of the map for determining parameters depicted in FIG. 12. Of the 4 parameters, 3 parameters, that is, N-times mode value N; number of subfields Z; and number of gradation display points K, are determined by the map shown in FIG. 13(*b*), and the remaining one parameter, that is, the multiplication factor A of the multiplier 12, is determined by the map shown in FIG. 13(*a*). In the map shown in FIG. 13(*b*), the horizontal axis represents the average level Lav, and the vertical axis represents the peak level Lpk. In the map shown in FIG. 13(*a*), the horizontal axis represents the average level Lav, and the vertical axis represents the multiplication factor A. The maps shown in FIGS. 13(*a*), (*b*) are both divided into 6 non-uniform (here, the column width widens the larger the average level) columns C1, C2, C3, C4, C5, C6 parallel to the vertical axis.

As is clear from the map shown in FIG. 13(*b*), the multiplier modes of the PDP driving signal in columns C1, C2, C3, C4, C5, C6 become 6-times, 5-times, 4-times, 3-times, 2-times, 1-times, respectively. Further, as is clear from the map shown in FIG. 13(*a*), the multiplication factor A in each of columns C1, C2, C3, C4, C5, C6 decreases linearly as the average level increases. That is, in column C1, it linearly decreases from 1 to 5/6, in column C1, it linearly decreases from 1 to 5/6, in column C2, it linearly decreases from 1 to 4/5, in column C3, it linearly decreases from 1 to 3/4, in column C4, it linearly decreases from 1 to 2/3, in column C5, it linearly decreases from 1 to 1/2, in column C6, it linearly decreases from 1 to 1/3.

When only the map in FIG. 13(*b*) is utilized, when a certain image i changes to the next image i+1, if it is assumed, for example, that the display of image i is controlled by the parameters in column C4, and the display of image i+1 is controlled by the parameters in column C5, since the PDP driving signal changes from a 3-times mode to a 2-times mode, the image brightness changes gradationally. To correct the gradational change of this brightness, the map shown in FIG. 13(*a*) is used. In the above example, if it is assumed that the display of image i was performed in the vicinity of the right edge of column C4, since brightness is proportional to N×A, it would be proportional to $3\times\frac{2}{3}=2$. Further, if it is assumed that the display of image i+1 is performed in the vicinity of the left edge of column C5, since brightness is proportional to N×A, it would be proportional to $2\times1=2$. Therefore, both image i and image i+1 are driven at a 2-times brightness, and the gradational change of brightness disappears. Further, when the average level of an image is changing in the direction of becoming brighter, for example, when it is changing from the left edge to the right edge within column C5, PDP drive is performed using a 2-times mode, but because the multiplication factor A changes linearly from 1 to 1/2, the brightness also changes linearly from 2-times ($2\times1$) to 1-times ($2\times\frac{1}{2}$).

As is clear from the above, the number of subfields Z is reduced as the average level of brightness (Lav) becomes lower. As the average level of brightness (Lav) drops, an image darkens, and becomes hard to see. Since the weight of a subfield can be enlarged by reducing the number of subfields for an image like this, the whole screen can be made brighter.

Further, the number of subfields Z is increased as the peak level of brightness (Lpk) becomes lower. When the peak level (Lpk) drops, in addition to the changing width of the brightness of an image becoming narrower, the entire image becomes a dark region. By increasing the number of subfields Z for an image like this, since the weight of a subfield can be reduced, even if the subfield is moved up or moved down, should a pseudo-contour be generated, it can be kept to a weak pseudo-contour.

Further, the weighting multiplier N is increased as the average level of brightness (Lav) becomes lower. As the average level of brightness (Lav) drops, an image darkens, and becomes hard to see. By increasing the weighting multiplier N for an image like this, the whole screen can be made brighter.

Further, the multiplication factor A is increased as the average level of brightness (Lav) becomes lower. As the average level of brightness (Lav) drops, an image darkens, and becomes hard to see. By increasing the multiplication factor A for an image like this, the overall image can be made brighter, and gradability can be increased as well.

Further, the weighting multiplier N is decreased as the peak level of brightness (Lpk) becomes lower. When the peak level of brightness (Lpk) drops, in addition to the changing width of the brightness of an image becoming narrower, the entire image becomes a dark region. By decreasing the weighting multiplier N for an image like this, the changing width of the luminance between display gradations becomes smaller, enabling the rendering of fine gradation changes even within the dark image, and making it possible to increase gradability.

Further, the multiplication factor A is increased as the peak level of brightness (Lpk) becomes lower. When the peak level of brightness (Lpk) drops, in addition to the changing width of the brightness of an image becoming narrower, the entire image becomes a dark region. By increasing the multiplication factor A for an image like this, it becomes possible to make a distinct change in brightness even when the image is dark, and to increase gradability.

Figure 18:
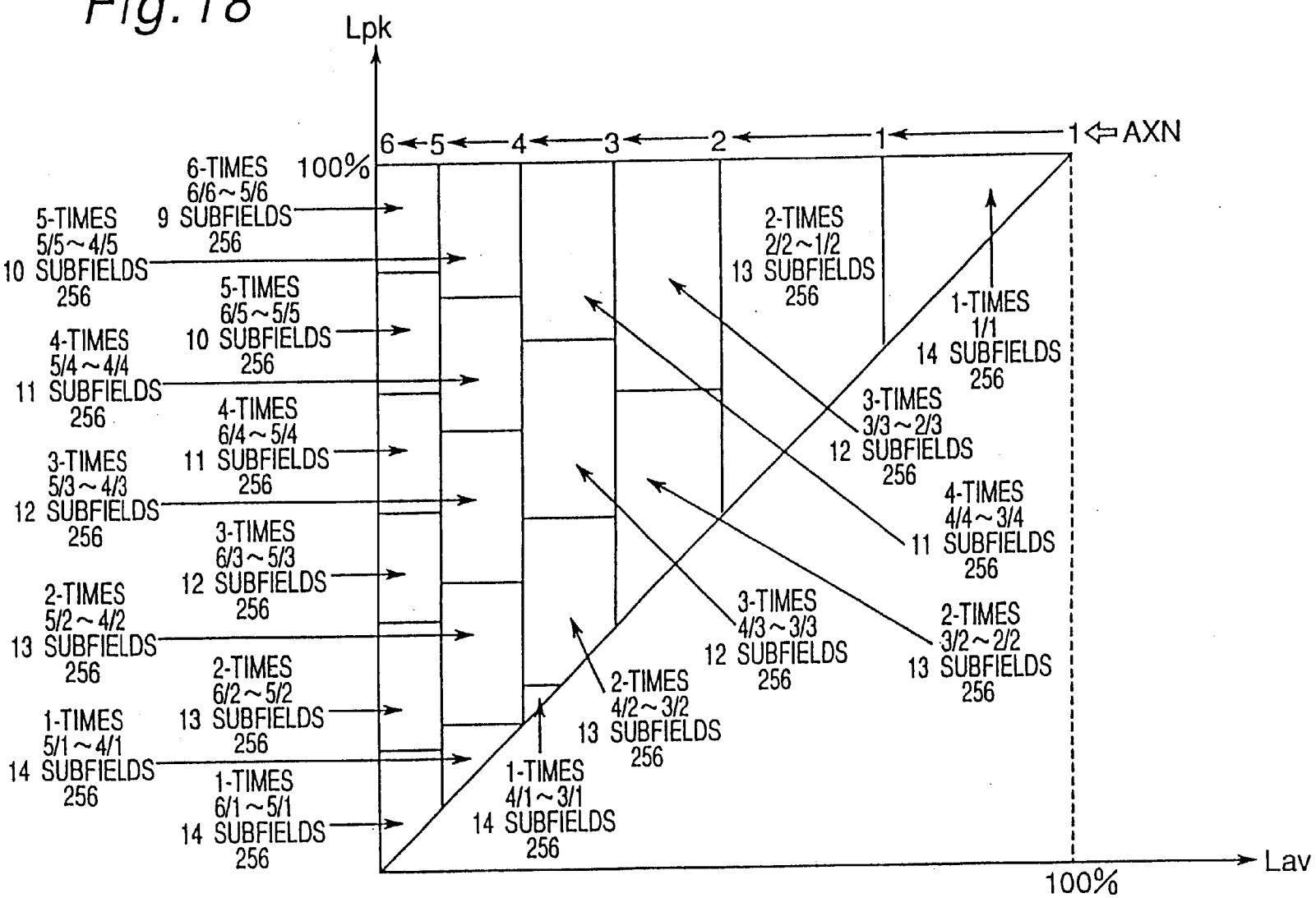
FIG. 18 shows a development schematic map, showing a variation of the map shown in FIG. 12.

Furthermore, the example given in FIG. 18 can be used as the map for determining parameters in the first embodiment. With this map, the multiplication factor A is changed in accordance with the average level of brightness (Lav) within each segment, and as the average level of brightness (Lav) becomes lower, the multiplication results of the multiplication factor A and the weighting multiplier N are smoothly increased. By so doing, even if the average level of brightness of an image changes while passing between each segment, because the multiplication results of the multiplication factor A and the weighting multiplier N, which determine image brightness, can be continuously changed even at the borders of each segment, it is possible to produce an image, in which image brightness smoothly changes.

The image characteristic determining device 30, as explained above, receives the average level (Lav) and peak level (Lpk), and specifies 4 parameters N, A, Z, K using a previously-stored map (FIG. 12). In addition to using a map, the 4 parameters can also be specified via calculation and computer processing.

The multiplier 12 receives the multiplication factor A and multiplies the respective R, G, B signals A times. In accordance with this, the entire screen becomes A-times brighter. Furthermore, the multiplier 12 receives a 16-bit signal, which is expressed out to the third decimal place for the respective R, G, B signals, and after using a prescribed operation to perform carry processing from a decimal place, the multiplier 12 once again outputs a 16-bit signal.

A display gradation adjusting device 14 receives the number of gradation display points K. The display gradation adjusting device 14 changes the brightness signal (16-bit), which is expressed in detail out to the third decimal place, to the nearest gradation display point (8-bit). For example, assume the value outputted from the multiplier 12 is 153.125. As an example, if the number of gradation display points K is 128, since a gradation display point can only take an even number, it changes 153.125 to 154, which is the nearest gradation display point. As another example, if the number of gradation display points K is 64, since a gradation display point can only take a multiplier of 4, it changes 153.125 to 152 (=4×38), which is the nearest gradation display point. In this manner, the 16-bit signal received by the display gradation adjusting device 14 is changed to the nearest gradation display point on the basis of the value of the number of gradation display points K, and this 16-bit signal is outputted as an 8-bit signal.

A picture signal-subfield corresponding device 16 receives the number of subfields Z and the number of gradation display points K, and changes the 8-bit signal sent from the display gradation adjusting device 14 to a Z-bit signal. As a result of this change, the above-mentioned Table 7-Table 20 are stored in the picture signal-subfield corresponding device 16. As one example, assume that the signal from the display gradation adjusting device 14 is 152, for instance, the number of subfields Z is 10, and the number of gradation display points K is 256. In this case, in accordance with Table 16, it is clear that the 10-bit weight from the lower bit is 1, 2, 4, 8, 16, 32, 48, 48, 48, 48. Furthermore, by looking at Table 9, the fact that 152 is expressed as (0001111100) can be ascertained from the table. This 10 bits is outputted to a subfield processor 18. As another example, assume that the signal from the display gradation adjusting device 14 is 152, for instance, the number of subfields Z is 10, and the number of gradation display points K is 64. In this case, in accordance with Table 16, it is clear that the 10-bit weight from the lower bit is 4, 8, 16, 32, 32, 32, 32, 32, 32, 32. Furthermore, by looking at the upper 10-bit portion of Table 11 (Table 11 indicates a number of gradation display points of 256, and a subfield number of 12, but the upper 10 bits of this table is the same as when the number of gradation display points is 64, and the subfield number is 10), the fact that 152 is expressed as (0111111000) can be ascertained from the table. This 10 bits is outputted to the subfield processor 18.

The subfield processor 18 receives data from a subfield unit pulse number setting device 34, and decides the number of sustaining pulses put out during sustain period P3. Table 1-Table 6 are stored in the subfield unit pulse number setting device 34. The subfield unit pulse number setting device 34 receives from an image characteristic determining device 30 the value of the N-times mode N, the number of subfields Z, and the number of gradation display points K, and specifies the number of sustaining pulses required in each subfield.

As an example, assume, for instance, that it is the 3-times mode (N=3), the subfield number is 10 (Z=10), and the number of gradation display points is 256 (K=256). In this case, in accordance with Table 3, judging from the row in which the subfield number is 10, sustaining pulses of 3, 6, 12, 24, 48, 96, 144, 144, 144, 144 are outputted for each of subfields SF1, SF2, SF3, SF4, SF5, SF6, SF&, SF8, SF9, SF10, respectively. In the above-described example, since 152 is expressed as (0001111100), a subfield corresponding to a bit of "1" contributes to light emission. That is, a light emission equivalent to a sustaining pulse portion of 456 (=24+48+96+144+144) is achieved. This number is exactly equivalent to 3 times 152, and the 3-times mode is executed.

As another example, assume, for instance, that it is the 3-times mode (N=3), the subfield number is 10 (Z=10), and the number of gradation display points is 64 (K=64). In this case, in accordance with Table 3, judging from subfields SF3, SF4, SF5, SF6, SF&, SF8, SF9, SF10, SF11, SF12 of the row in which the subfield number is 12 (The row in Table 3 in which the subfield number is 12 has a number of gradation display points of 256, and the subfield number is 12, but the upper 10 bits of this row is the same as when the number of gradation display points is 64 and the subfield number is 10. Therefore, subfields SF3, SF4, SF5, SF6, SF&, SF8, SF9, SF10, SF11, SF12 of the row in which the subfield number is 12 correspond to subfields SF1, SF2, SF3, SF4, SF5, SF6, SF&, SF8, SF9, SF10 when the subfield number is 10.), sustaining pulses of 12, 24, 48, 96, 96, 96, 96, 96, 96, 96 are outputted for each, respectively. In the above-described example, since 152 is expressed as (0111111000), a subfield corresponding to a bit of "1" contributes to light emission. That is, a light emission equivalent to a sustaining pulse portion of 456 (=24+48+96+96+96+96+96) is achieved. This number is exactly equivalent to 3 times 152, and the 3-times mode is executed.

In the above-described example, the required number of sustaining pulses can also be determined via calculations without relying on Table 3, by multiplying the 10-bit weight obtained in accordance with Table 16 by N (This is 3 times in the case of the 3-times mode.). Therefore, the subfield unit pulse number setting device 34 can provide an N-times calculation formula without storing Table 1-Table 6. Further, the subfield unit pulse number setting device 34 can also set a pulse width by changing to a pulse number that accords with the type of display panel.

Pulse signals required for setup period P1, write period P2 and sustain period P3 are applied from the subfield processor 18, and a PDP driving signal is outputted. The PDP driving signal is applied to a data driver 20, and a scanning/holding/erasing driver 22, and a display is outputted to a plasma display panel 24.

A vertical synchronizing frequency detector 36 detects a vertical synchronizing frequency. The vertical synchronizing frequency of an ordinary television signal is 60 Hz (standard frequency), but the vertical synchronizing frequency of the picture signal of a personal computer or the like is a frequency higher than the standard frequency, for example, 72 Hz. When the vertical synchronizing frequency is 72 Hz, 1 field time becomes 1/72 second, and is shorter than the ordinary 1/60 second. However, since the setup pulse, writing pulse and sustaining pulse that comprise a PDP driving signal do not change, the number of subfields that can be introduced into 1 field time decreases. In a case such as this, SF1, which is the least significant bit, is omitted, the number of gradation display points K is set at 128, and an even gradation display point is selected. That is, when the vertical synchronizing frequency detector 36 detects vertical synchronizing frequency that is higher than a standard frequency, it sends a signal specifying the contents thereof to the image characteristic determining device 30, and the image characteristic determining device 30 reduces the number of gradation display points K. Processing similar to that described above is performed for the number of gradation display points K.

As explained above, in addition to changing the subfield number Z of the 4 parameters by combining the average level Lav and the peak level Lpk of 1 field, since it is also possible to change the other parameters: the value of the N-times mode N; the multiplication factor A of the multiplier 12; number of gradation display points K, the highlighting and adjusting of an image can be performed separately in accordance with whether the image is dark or bright. Further, when an entire image is bright, the brightness can be lowered, and power consumption can also be reduced.

Further, the first embodiment provides a 1 field delay 11, and changes the rendering form with regard to a 1 field screen, which detects an average level Lav and a peak level Lpk, but the 1 field delay 11 can be omitted, and the rendering form can be changed for a 1 field screen following a detected 1 field. Since there is image continuity in a dynamic image, this is not particularly problematic because in a certain scene, the detection results are practically the same for an initial 1 field and the field thereafter.

Second Embodiment

Figure 14:
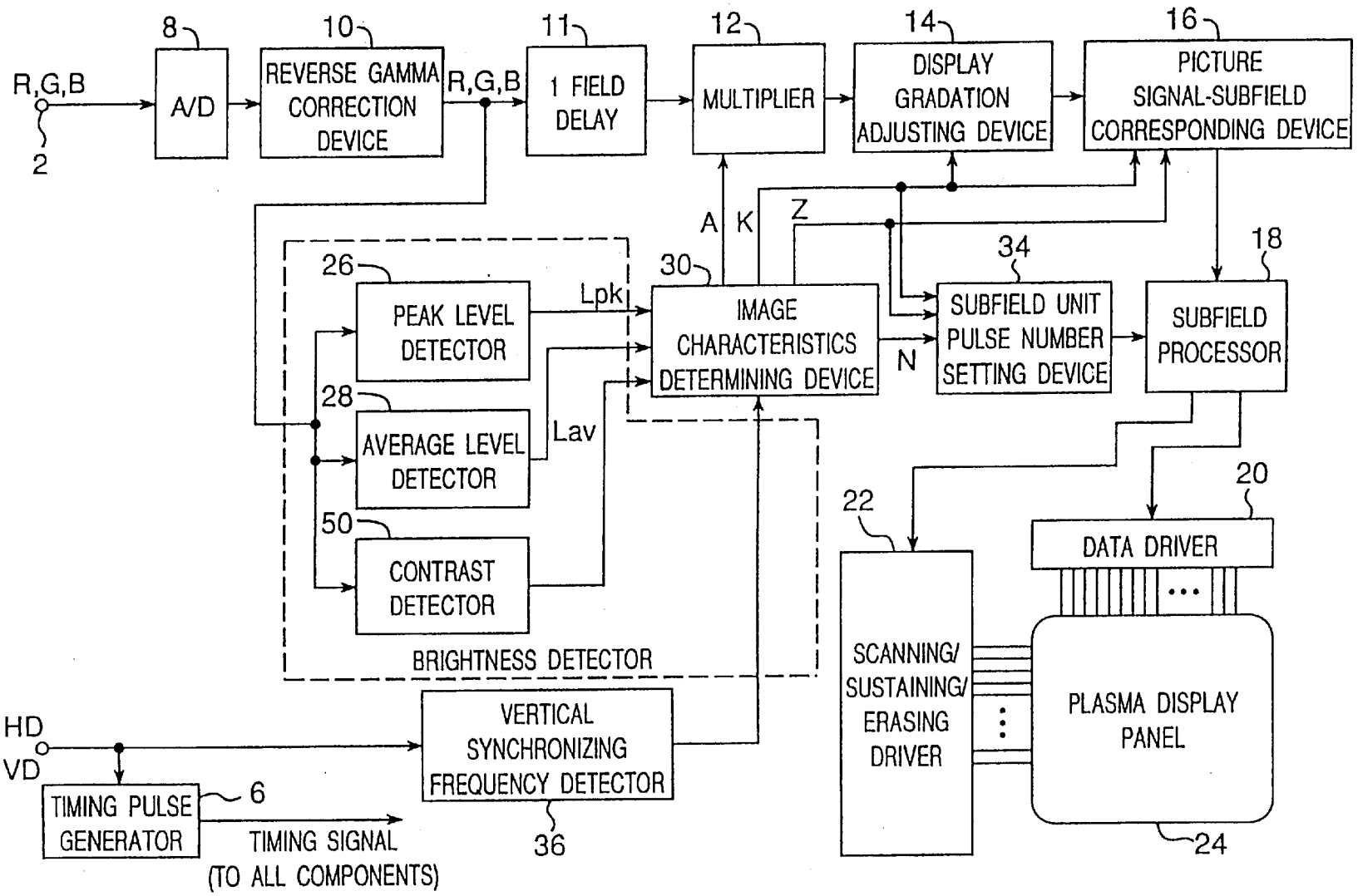
FIG. 14 shows a block diagram of a display apparatus of a second embodiment.

FIG. 14 shows a block diagram of a display apparatus of a second embodiment. This embodiment, relative to the embodiment in FIG. 11, further provides a contrast detector 50 parallel to an average level detector 28. The image characteristic determining device 30 determines the 4 parameters on the basis of image contrast in addition to the peak level Lpk and average level Lav, or in place thereof. For example, when contrast is intense, this embodiment can decrease the multiplication factor A.

Third Embodiment

Figure 15:
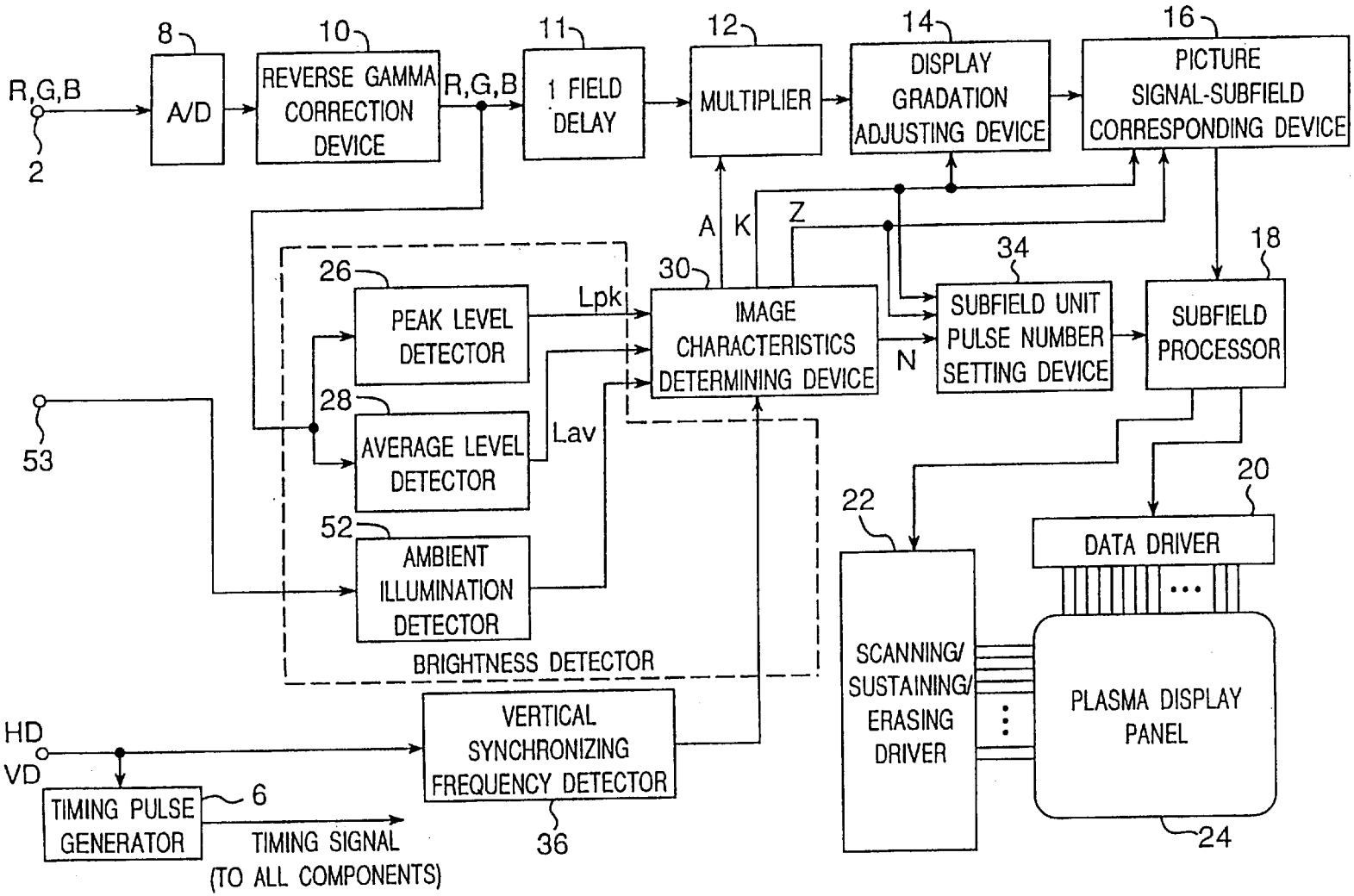
FIG. 15 shows a block diagram of a display apparatus of a third embodiment.

FIG. 15 shows a block diagram of a display apparatus of a third embodiment. This embodiment, relative to the embodiment in FIG. 11, further provides an ambient illumination detector 52. The ambient illumination detector 52 receives a signal from ambient illumination 53, outputs a signal corresponding to ambient illumination, and applies this signal to the image characteristic determining device 30. The image characteristic determining device 30 determines the 4 parameters on the basis of ambient illumination in addition to the peak level Lpk and average level Lav, or in place thereof. For example, when ambient illumination is dark, this embodiment can decrease the multiplication factor A, or the weighting multiplier N.

Fourth Embodiment

Figure 16:
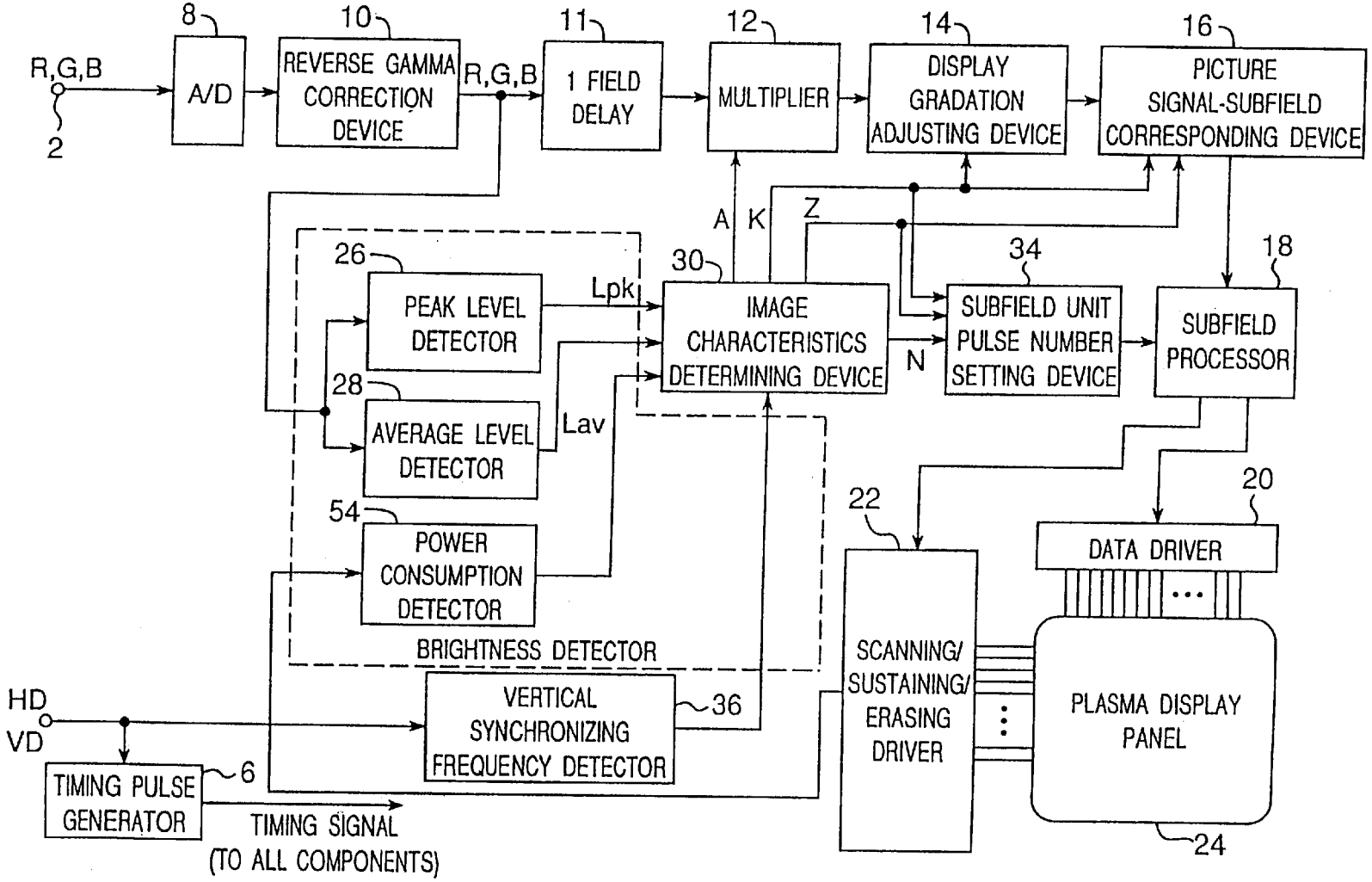
FIG. 16 shows a block diagram of a display apparatus of a fourth embodiment.

FIG. 16 shows a block diagram of a display apparatus of a fourth embodiment. This embodiment, relative to the embodiment in FIG. 11, further provides a power consumption detector 54. The power consumption detector 54 outputs a signal corresponding to the power consumption of the plasma display panel 24, and drivers 20, 22, and applies this signal to the image characteristic determining device 30. The image characteristic determining device 30 determines the 4 parameters on the basis of the power consumption of the plasma display panel 24 in addition to the peak level Lpk and average level Lav, or in place thereof. For example, when power consumption is high, this embodiment can decrease the multiplication factor A, or the weighting multiplier N.

Fifth Embodiment

Figure 17:
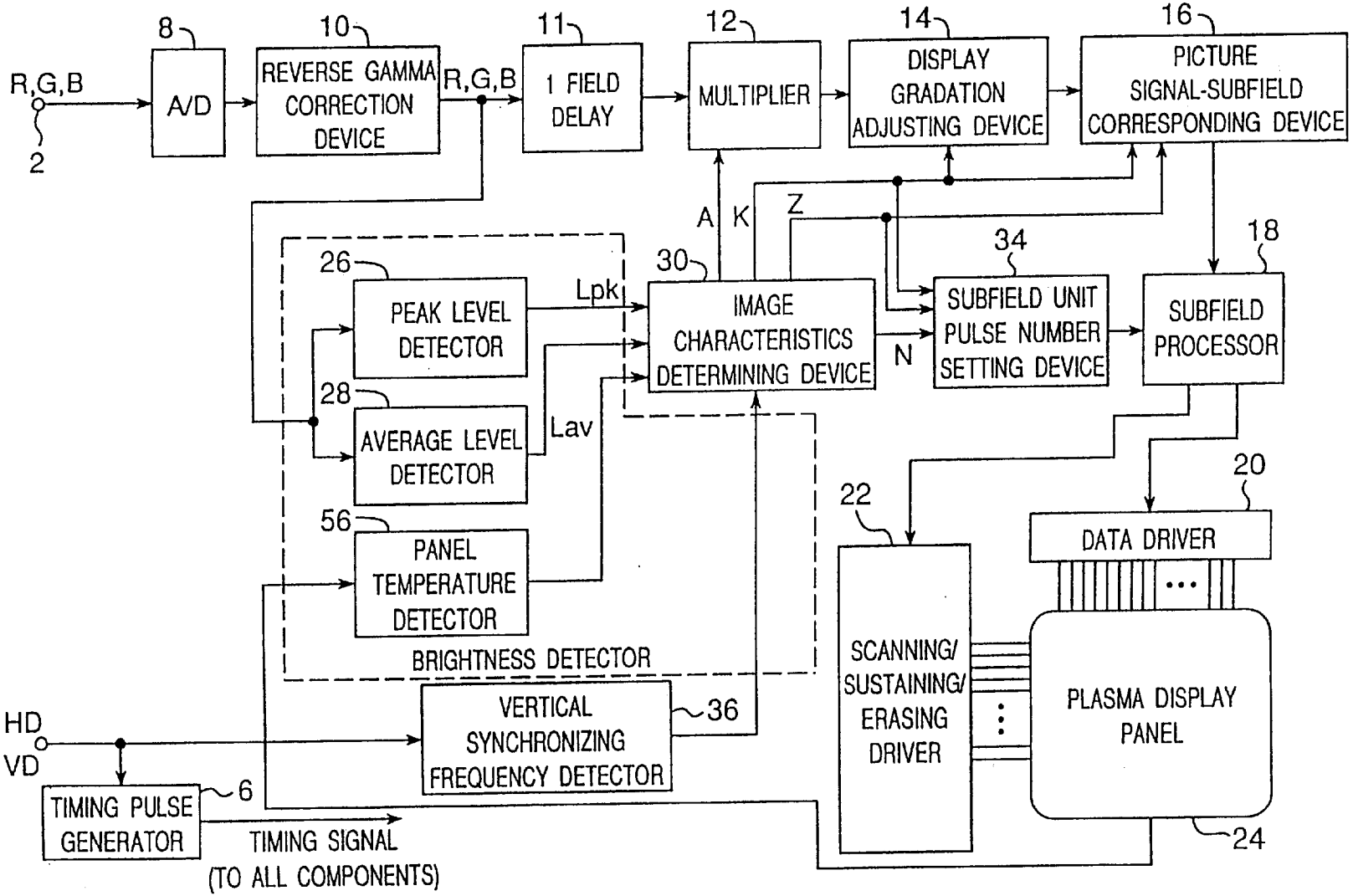
FIG. 17 shows a block diagram of a display apparatus of a fifth embodiment.

FIG. 17 shows a block diagram of a display apparatus of a fifth embodiment. This embodiment, relative to the embodiment in FIG. 11, further provides a panel temperature detector 56. The panel temperature detector 56 outputs a signal corresponding to the temperature of the plasma display panel 24, and applies this signal to the image characteristic determining device 30. The image characteristic determining device 30 determines the 4 parameters on the basis of the temperature of the plasma display panel 24 in addition to the peak level Lpk and average level Lav, or in place thereof. For example, when the temperature is high, this embodiment can decrease the multiplication factor A, or the weighting multiplier N.

As described in detail above, because the display apparatus capable of adjusting the subfield number in accordance with brightness related to the present invention adjusts, on the basis of screen brightness data, the number of subfields Z, and also adjusts the value of the N-times mode N, the multiplication factor A of the multiplier 12, and the value of the number of gradation display points K, it is capable of creating an optimum image in accordance with screen brightness. More specifically, the advantages of the present invention are as follows.

1) When the average level is low, there is also a margin in panel power consumption. When this happens, increasing the weighting multiplier N, and displaying an image brightly enables the reproduction of a beautiful image with a better contrast-sensation. However, because the number of subfields Z was fixed in past driving methods, without being able to adequately set the weighting multiplier N to a sufficiently large value, it was not possible to reproduce a beautiful image with a contrast-sensation. In accordance with the present invention, when the average level is low, since a display can be produced by reducing the number of subfields Z, it is possible to decrease the number of writes in 1 field time, and by so doing, to enable splitting to increase the weighting multiplier N. By so doing, since the weighting multiplier can be made sufficiently large, and an image can be made bright, it is possible to reproduce a beautiful image with a sufficient contrast-sensation even compared to a CRT or the like. Further, by reducing the number of subfields Z at this time, the pseudo-contour noise generated by a dynamic image worsens, but when the frequency of images that generate pseudo-contour noise is not that high, and the type of image, such as dynamic image, and static image, is comprehensively determined, using the driving method in accordance with the present invention enables the reproduction of an extremely beautiful image.

2) When the average level is high, panel power consumption increases. When this happens, if the weighting multiplier N is not decreased, and display is performed without darkening the image, there is a possibility that the power consumption of the display device will exceed the rated power consumption, and that the panel will be damaged as a result of a rise in temperature. However, because the number of subfields Z was fixed in past driving methods, decreasing the weighting multiplier N had no other effect than to simply prevent an increase in power consumption, and a rise in panel temperature. In accordance with the present invention, when the average level is high, since the subfield number Z can be increased, and the weighting multiplier N can be decreased, in addition to preventing an increase in power consumption, and a rise in panel temperature, the pseudo-contour noise generated by a dynamic image can also be reduced. By so doing, when the average level is high, a more beautiful, stable image than in the past can be reproduced even for a dynamic image.

3) When the peak level is low, the number of gradations assigned to an entire picture decreases. In accordance with the present invention, since the multiplication factor A is increased, and the weighting multiplier N is decreased, the number of gradations assigned to an entire image can be increased. By so doing, since sufficient gradations can be provided to an entire image, a beautiful image can reproduced, even for an image with a low peak level that is dark overall.

What is claimed is:

1. A display apparatus for creating, for each image, a number of subfields Z from a first subfield to a Zth subfield in accordance with a Z bit representation of each pixel, a weight of each subfield, and a number of gradation display points, the display apparatus comprising:

a contrast detector that detects contrast on a display panel displaying the image;

an image characteristic determining device that determines a subfield number Z and a weighing multiple, while maintaining a same number of gradation display points, based on the contrast on the display panel; and a weight setting device that multiplies the weight of each subfield by the weighing multiple;

wherein the image characteristic determining device decreases the subfield number Z and increases the weighing multiple as the contrast on the display panel decreases.

2. The display apparatus according to claim 1, wherein the image characteristic determining device determines a multiplication factor for amplifying an image signal, based on the contrast, the image characteristic determining device comprising a multiplier for amplifying the image signal by the multiplication factor.

3. The display apparatus according to claim 2, wherein the image characteristic determining device decreases the multiplication factor as the contrast increases.

4. The display apparatus according to claim 1, further comprising:

an average level detector that detects an average image brightness level, and the image characteristic determining device determining the subfield Z and the weighing multiple, while maintaining the same number of gradation display points, based on the average image brightness level detected by the average level detector, and on the contrast detected by the contrast detector.

5. A display method for creating, for each image, a number of subfields Z from a first subfield to a Zth subfield in accordance with a Z bit representation of each pixel, a weight of each subfield, and a number of gradation display points, the display method comprising:

detecting a contrast on a display panel displaying the image;

determining a subfield number Z and a weighing multiple, while maintaining a same umber of gradation display points, based on the contrast; and multiplying the weight of each subfield by the weighing multiple, wherein the subfield number Z decreases and the weighing multiple increases as the contrast on the display panel decreases.

6. The display method according to claim 5, wherein the determining determines a multiplication factor for amplifying an image signal, based on the contrast, and the display method further comprising multiplying the image signal by the multiplication factor to amplify the image signal.

7. The display method according to claim 5, wherein the determining decreases the multiplication factor as the contrast increases.

8. The display method according to claim 5, further comprising detecting an average image brightness level, and wherein the determining determines the subfield number Z and the weighing multiple, while maintaining the same number of gradation display points, based on the detected average image brightness level and the detected contrast.

9. A display apparatus for creating, for each image, a number of subfields Z from a first subfield to a Zth subfield in accordance with a Z bit representation of each pixel, a weight of each subfield, a multiplication factor for amplifying an image signal, and a number of gradation display points, the display apparatus comprising:

a contrast detector that detects contrast on a display panel displaying the image;

an image characteristic determining device that determines a subfield number Z, a weighing multiple and the multiplication factor based on the contrast on the display panel;

a multiplier for amplifying the image signal by the multiplication factor; and a weight setting device that multiplies the weight of each subfield by the weighing multiple, wherein the image characteristic determining device decreases the multiplication factor as the contrast on the display panel increases.

* * * * *

UNITED STATES PATENT AND TRADEMARK OFFICE

CERTIFICATE OF CORRECTION

PATENT NO. : 6,388,645 B2
DATED : May 14, 2002
INVENTOR(S) : M. Kasahara et al.

It is certified that error appears in the above-identified patent and that said Letters Patent is hereby corrected as shown below:

Title page,
Item [73], Assignee, after "Co." insert -- , --.

Column 28,
Line 40, "umber" should be -- number --.

Signed and Sealed this

Eighteenth Day of March, 2003

JAMES E. ROGAN
*Director of the United States Patent and Trademark Office*